US008100182B2

(12) United States Patent
Smith et al.

(10) Patent No.: US 8,100,182 B2
(45) Date of Patent: Jan. 24, 2012

(54) LOOSE TUBE FLYING LEAD ASSEMBLY

(75) Inventors: Ronald E. Smith, Seabrook, TX (US); John Theobald, Daytona Beach, FL (US)

(73) Assignee: Deep Down, Inc., Channelview, TX (US)

( * ) Notice: Subject to any disclaimer, the term of this patent is extended or adjusted under 35 U.S.C. 154(b) by 658 days.

(21) Appl. No.: 12/208,448

(22) Filed: Sep. 11, 2008

(65) Prior Publication Data

US 2010/0059229 A1 Mar. 11, 2010

(51) Int. Cl.
*E21B 43/01* (2006.01)

(52) U.S. Cl. ..... 166/346; 166/339; 166/344

(58) Field of Classification Search ..... 166/346, 166/339, 341, 344, 368, 381, 385; 405/158, 405/168.1, 168.2, 171, 173, 184.4
See application file for complete search history.

(56) References Cited

U.S. PATENT DOCUMENTS

| | | | | | |
|---|---|---|---|---|---|
| 4,075,862 | A * | 2/1978 | Ames | 405/169 |
| 4,116,044 | A * | 9/1978 | Garrett | 73/40.5 R |
| 4,620,818 | A * | 11/1986 | Langner | 405/169 |
| 4,671,702 | A * | 6/1987 | Langner | 405/169 |
| 5,265,980 | A * | 11/1993 | Lugo et al. | 405/169 |
| 5,289,882 | A * | 3/1994 | Moore | 166/379 |
| 5,417,459 | A * | 5/1995 | Gray et al. | 285/26 |
| 5,794,701 | A * | 8/1998 | Cunningham et al. | 166/341 |
| 6,024,514 | A * | 2/2000 | Ostergaard | 405/170 |
| 6,102,124 | A * | 8/2000 | Skeels et al. | 166/347 |
| 6,223,675 | B1 * | 5/2001 | Watt et al. | 114/312 |
| 6,481,504 | B1 * | 11/2002 | Gatherar | 166/344 |
| 6,484,806 | B2 * | 11/2002 | Childers et al. | 166/351 |
| 6,588,980 | B2 * | 7/2003 | Worman et al. | 405/158 |
| 6,742,594 | B2 * | 6/2004 | Langford et al. | 166/350 |
| 6,796,261 | B2 * | 9/2004 | Colyer | 114/258 |
| 6,827,597 | B1 * | 12/2004 | Metzbower et al. | 439/320 |
| 6,880,640 | B2 * | 4/2005 | Barratt et al. | 166/346 |
| 7,032,673 | B2 * | 4/2006 | Dezen et al. | 166/341 |
| 7,044,228 | B2 * | 5/2006 | Langford et al. | 166/350 |
| 7,165,619 | B2 * | 1/2007 | Fox et al. | 166/343 |
| 7,172,447 | B2 * | 2/2007 | Allensworth et al. | 439/271 |
| 7,243,729 | B2 * | 7/2007 | Tyrrell et al. | 166/338 |
| 7,298,672 | B1 * | 11/2007 | Tenghamn et al. | 367/176 |
| 7,318,479 | B2 * | 1/2008 | Williams | 166/341 |
| 7,467,662 | B2 * | 12/2008 | Smith | 166/343 |
| 7,802,624 | B2 * | 9/2010 | Barratt | 166/338 |
| 7,866,398 | B2 * | 1/2011 | Barratt et al. | 166/341 |
| 2001/0034153 | A1 * | 10/2001 | McIntosh et al. | 439/364 |
| 2007/0227740 | A1 * | 10/2007 | Fontenette et al. | 166/344 |
| 2008/0143100 | A1 * | 6/2008 | Webster | 285/18 |

* cited by examiner

*Primary Examiner* — Thomas Beach
*Assistant Examiner* — Matthew Buck
(74) *Attorney, Agent, or Firm* — Samuel Digirolamo; Husch Blackwell LLP

(57) ABSTRACT

In combination, the loose tube flying lead includes: a) a pair of improved cobra head assemblies, each being able to receive a variety of different stab-plates with minimal modification; b) a pair of bend limiters, one extending from each cobra head assembly and c) an elongate bundle of non-constrained interior conduits surrounded by an over-hose, the over-hose being connected to each bend limiter. The over-hose may rotate independently of the bend limiters and the cobra head assemblies.

14 Claims, 17 Drawing Sheets

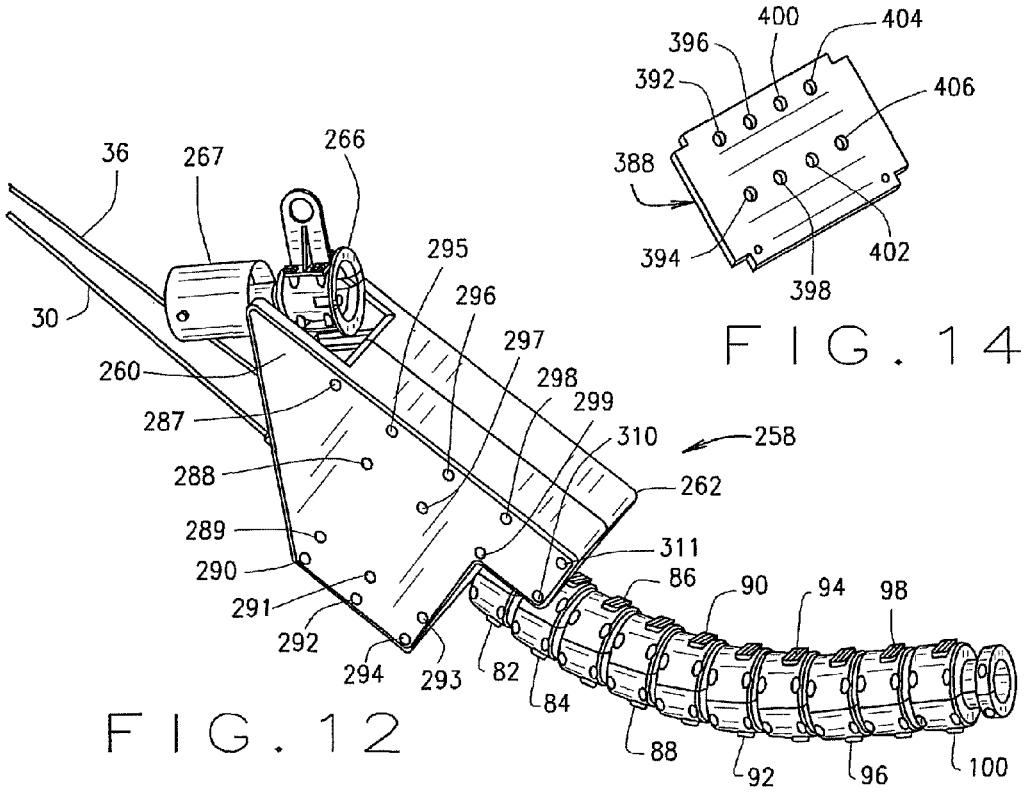
FIG. 12
FIG. 14
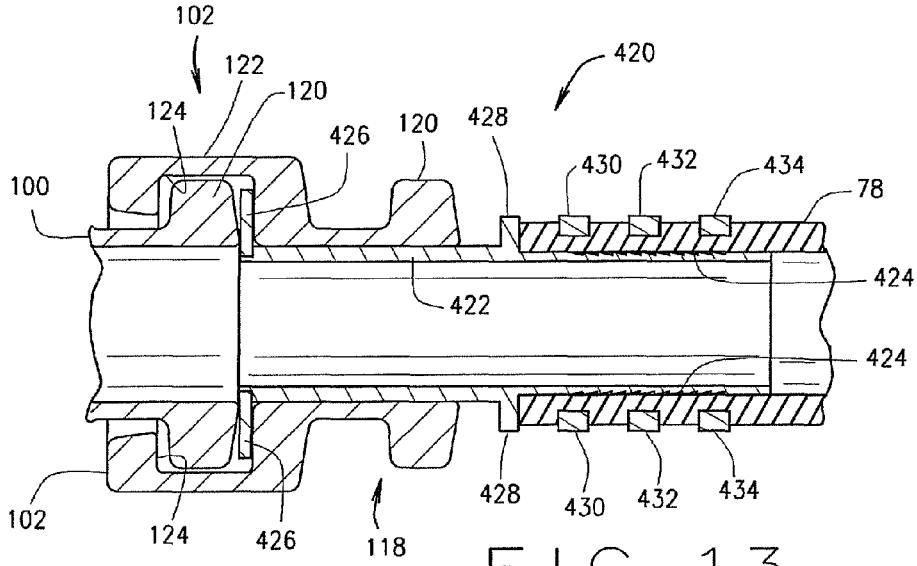
FIG. 13

LOOSE TUBE FLYING LEAD ASSEMBLY

DESCRIPTION OF THE PRIOR ART

The terms "umbilical," "jumper" and/or "flying lead" are not always used with precision in the oil and gas industry or in the literature. For example, claim 1 of U.S. Pat. No. 6,102,124 describes a "flying lead hydraulic umbilical." U.S. Pat. No. 6,957,929 also uses the two terms interchangeably. Each of these devices, properly understood, is distinct in both design and application. We therefore intend to distinguish and define these terms with greater precision herein.

A. Umbilicals

For purposes of this application an "umbilical" is defined as a composite structure composed of a multitude of conduits sheathed in an outer jacket of some form, generally including some combination of steel tubes, thermoplastic hoses, electric cables, fiber optic cables and/or fillers for use in subsea exploration and production of oil and gas. Umbilicals extend from either a) a host on the ocean surface or on land to a subsea distribution point or b) from one subsea distribution point to another subsea distribution point. Umbilicals are long and stiff, typically extending several thousands of feet from the host on the surface to the seafloor; or several thousands of feet to tens of miles from shore facilities to subsea distribution points or between subsea distribution points.

The interior conduits within an umbilical are typically helically wound and are sheathed with an over extruded thermoplastic cover or in a textile/thermoplastic roving. The practice of sheathing and tightly binding the composite structure together greatly increases the stiffness of an umbilical with the addition of each additional conduit and the thickness of the sheathing.

The following references describe various umbilicals: U.S. Pat. Nos. 7,239,781; 7,158,703; 6,612,370; US 2006/0193698; U.S. Pat. Nos. 6,556,780; 6,538,198; 6,472,614; US 2002/0122664; U.S. Pat. Nos. 6,102,077; 4,726,314 and 3,526,086.

B. Jumpers

In the industry the terms "flying lead" and "jumper" are sometimes used interchangeably, or in combination, for example see U.S. Pat. No. 6,880,640 entitled "Steel Tube Flying Lead Jumper Connector." A jumper is an apparatus designed to convey a single item, such as crude oil, natural gas, hydraulic fluids, service chemicals, electric power/signals, or fiber optic signals. For purposes of this explanation, electric power and electric signals are considered a single item. Jumpers may be composed of a single conduit such as a thermoplastic hose, a steel tube, a electrical cable or a fiber optical cable or helically bound and sheathed multi-conduits structure; however the jumper only conveys a single item such as hydraulic fluid. Each end of a jumper is terminated with a purpose built coupling. Jumpers may be tens of feet to several hundreds of feet long. Most jumpers are flexible, but some are rigid. Rigid jumpers such as those used to convey crude oil are typically installed with the aid of spreader bar.

C. Flying Leads

A "flying lead" is typically a flexible or semi-flexible composite multi-conduit structure either a) extending from a first item of subsea equipment to a second item of subsea equipment on the seafloor or b) within the water column for the purpose of controlling and/or maintaining equipment used in the exploration and production of oil and gas from subsurface reservoirs. Flying leads are typically tens of feet to several hundreds of feet long, but may be longer. Both flying leads and umbilicals may conduct fluids, such as hydraulic control fluids, service chemicals such as methanol along with various types of inhibitors, electrical power/signals and fiber optic signals.

Flying leads connect two pieces of subsea equipment which may be collectively referred to as subsea structures. Typically examples of subsea equipment are an umbilical termination assembly (UTA), a subsea distribution unit (SDU), a subsea control module (SCM), a subsea production or water injection tree (Tree), a subsea manifold or other ancillary items suspended in the water column or mounted on the seafloor. Flying leads commonly connect the UTA to the SDU or a SCM on a Tree to the SDU. Flying leads may also be used to interconnect other types of subsea exploration and production equipment. Flying leads may be installed by divers in shallow water, but are most commonly installed by remote operated vehicles (ROV's) in deeper water.

Prior art "flying lead assemblies" typically include: a) a pair of purpose built frames referred to in the industry vernacular as "cobra heads;" b) a pair of stab-plates which are typically attached to the cobra head using a series of structural bolts, washers, lock washers and nuts; c) a series of wet-matable couplings which are mounted within the stab-plates, which may be any combination of hydraulic, electric or optical couplings; d) a pair of bend limiter assemblies, one extending from each cobra head assembly; e) an elongate bundle of interior conduits for the transmission of fluids, electrical power/signals and/or optical signals; f) a means of managing the interior conduits, typically helically winding the interior conduits into a stiff compact core then either over-extruded the core with thermoplastic, binding with textile/thermoplastic roving or sheathing within a tightly fitting over-hose; and g) a means for anchoring a strength element to the frame, typically including a pair of elongate and heavy armor pot terminations filled with epoxy resin, one attached to the rear end of each cobra head. Deep Down, Inc., the assignee of this patent application, manufactures cobra head assemblies and markets them under the trademark MORAY®.

To applicants' knowledge, there is no cobra head which has a universal frame with interchangeable interface elements to accommodate various stab-plates. To applicants' knowledge, there is no compact serviceable and configurable strength termination to interface directly with the cobra head and the conduit elements. To applicants' knowledge, there is no cobra head with an integrated buoyant element to aid installation. To applicants' knowledge, there is no cobra head with an integrated buoyancy element that provides storage for flexible conduits terminated with couplings for the means of supporting functions independent of those provided by a stab-plate. There is a need for improved flying leads.

Cobra head assemblies contain what is often referred to in the industry as a stab-plate. Stab-plates are so named because the two plates stab into contact with each other. This plate may also be called a "junction plate" or more simply a "J-Plate," a "multiple quick connect junction plate" or simply a "MQC Plate." For simplicity, these plates will collectively hereinafter be referred to as "stab-plates." Stab-plates are produced in several different styles and configurations from several different vendors.

Stationary subsea structures typically contain what is often referred to as the "fixed stab-plate" and the flying lead assembly contains what is often referred to as the "flying stab-plate." The fixed stab-plate may also be referred to by some in the industry as the "inboard stab-plate." The flying stab-plate may also be referred to as the "outboard stab-plate." The fixed stab-plate may contain a multitude of hydraulic, electric and/or optical couplings which are arranged to engage similar couplings on the flying stab-plate. The ROV stabs the flying stab-plate into the fixed stab-plate on the SCM, for example.

Prior to this invention, each cobra head assembly was specifically designed to accommodate the stab-plate from a specific vendor and the number and type of conduit elements as specified by the subsea production controls system supplier. These design complications sometimes delayed production of prior art flying leads due to re-engineering efforts and/or required vendors to carry large inventories of specialized parts to accommodate different types of stab-plates and conduit types and configurations. The improved cobra head assembly of the present invention has interchangeable stab-plate interface elements that will accommodate stab-plates from different vendors. The stab-plate interface elements will mount in a frame which is referred to as "universal" because it will accommodate stab-plates from several different vendors.

The present invention requires only one compact light weight frame that can accommodate different interchangeable stab-plate interface elements, one interface element for each type of stab-plate. This universal frame is constructed from fewer parts than the prior art frames and hence reduces weight and inventory carrying costs as well as engineering and production time. The components of the universal frame may be fabricated in volume with great uniformity, quickly and inexpensively from a burn table which is ubiquitous in most steel fabrication shops.

D. Load Bearing Assemblies

The present invention has a first load bearing assembly and a second load bearing assembly. The first load bearing assembly has two alternative configurations, depending on whether the interior conduits are steel tubes or thermoplastic conduits. The terms first load bearing assembly and a) steel tube load bearing assembly and b) plastic hose load bearing assembly are synonymous. The terms second load bearing assembly and over-hose load bearing assembly are synonymous.

1. First Load Bearing Assembly a) Steel Tube Load Bearing Assembly

If the interior conduits include steel tubes, then a "spool" design is used to connect the steel tubes to the strength termination; this strength termination will hereinafter be referred to as the "steel tube load bearing assembly."

b) Plastic Hose Load Bearing Assembly

If the interior conduits include thermoplastic hoses, electrical and/or optical cables, then a "wire rope" design is used in lieu of the "spool" design. Thermoplastic hoses and cables are incapable of supporting handling and installation loads. In this case, a wire rope is connected to the strength termination element in each universal frame by a compact removable epoxy termination mounted in the termination block, which is slightly larger than the spool described above. This termination will hereinafter be referred to as the "plastic hose load bearing assembly." The compact epoxy termination contains a conic profile with the larger OD opposed to the elongate conduit bundle, the wire rope strands are fanned out and epoxy is poured into the termination. The resulting wedge shape combination in the compact epoxy termination can support up to the rated breaking strength of the wire rope. This wire rope termination is well known to those skilled in the art. The standardized strength terminations assemblies of the present invention significantly reduce the length and weight of the cobra head assembly and allows for the recovery and repair of the flying lead on the deck of a ship should it become necessary. As the parts that comprise the strength termination are standardized and relatively simple geometry they can be made in volume with great uniformity with a common burn table and automated CNC controlled lathe.

2. Second Load Bearing Assembly

The over-hose load bearing assembly includes a robust over-hose with over-hose connectors on each end. Each over-hose connector engages a bend limiter assembly which engages the bend limiter connector on each frame. The load is thus transferred from the over-hose through the over-hose connectors and the bend limiter assembly to the frame on each cobra head assembly. The over-hose load bearing assembly rotates freely and independently of each cobra head assembly which facilitates subsea installation.

A prior art bend limiter assembly extends from the cobra head assembly and surrounds a portion of the interior conduits and extends towards either the elongate bundle over-hose or sheathing. The articulating prior art bend limiter assembly prevents the interior conduits from exceeding their minimum bend radius. The bend limiter assembly of the prior art does not make a physical connection to the over hose or sheathing material surrounding the elongate conduit bundle and is incapable of transmitting loads to the frame. The bend limiter assembly of the present invention interfaces directly to a load bearing hose assembly and is capable of transmitting handling and installation loads to the universal frame via the bend limiter coupling.

Most prior art flying leads are composed of thermoplastic hoses and/or steel tubes which interface with the cobra head assembly in some form. These thermoplastic hoses and/or steel tubes are typically helically wound and taped and then ether inserted into a tightly fitting reinforced PVC over-hose or over-braided with textile/thermoplastic roving. This tightly fitting configuration leads to a stiff composite structure which makes installation more cumbersome than the present invention as the composite has stored energy which the ROV has to overcome during lead-in and make up.

Prior art over-hose and roving designs do not make a physical connection to either the prior art bend limiter assembly or the prior art frame assembly. Prior art designs employing the over-hose may therefore bunch up during installation which can lead to exposure of the interior conduits or breaks at the splice intersections. This can lead to abrasion and kinking of the interior conduits at the bend limiter interface and splice intersections. Prior art designs employing the over-hose typically use a clear PVC hose which contains a hard helical PVC reinforcement element. This type of prior art hose is subject to UV degradation and chemical attack both of which are common in most oilfield applications. The hose is manufactured in discrete lengths of 50', 100' and 200', this may necessitate splicing to achieve longer lengths. Two prevalent brands of prior art over-hose include "Tiger" hose manufactured by Kuriyama of American located in Schaumbureg, Ill.; www.kuryama.com and "Spiralite" hose manufactured by Pacific Echo located in Torrance Calif.; www.pacificecho.com.

The present invention incorporates a robust load bearing hose that surrounds the elongate interior conduits; fittings are placed on each end of the load bearing hose. The hose, interior conduits and fittings are referred to as an elongate bundle. Deep Down, Inc. markets the elongate bundle under the brand DOP™. The elongate bundle engages the bend limiter assembly on each cobra head assembly. This hose is capable of supporting full installation and handling loads and is UV stable as well as resistant to attack from most chemicals used in oilfield applications. The hose is abrasion resistant and stiffer than the prior art over-hose and has a minimum bend radius slightly larger than that of the smallest steel tube used in typical hydraulic applications but much smaller than traditionally flying leads. When steel tubes are used the elongate bundle will serve to maintain a minimum bend radius greater than that of the elongate conduits contained within. The hose used in the current invention can either be manufactured to length or use a series of hoses connected by high strength splices. The splices containing back to back hose barbs and swag fitting similar to those described above.

A disadvantage associated with prior art flying leads using thermoplastic hoses is premature rupture and shorter design life spans than project design. This may necessitate retrieval and replacement of prior art designs when the application design life is greater than that of the hose or in the event of hose rupture. Using prior art designs it is difficult to service the flying lead on the deck of a ship. The loosely bundled flying leads of the present invention make it possible to service the flying lead on the deck of a ship by disconnecting the threaded fittings from the back of each stab-plate assembly, attaching the elongate bundle and simply pulling the interior conduits through the bend limiter assembly and reconnecting the fittings on each stab-plate.

When steel tubes are used in the prior art it becomes necessary to anchor the tubes to the frame using tack welded retention sleeves and an armor pot containing epoxy resin. The tack welded retention sleeves serve as a shoulder to retain the steel tubes in the surrounding epoxy. Epoxy terminated prior art steel tube flying leads are not serviceable on the deck of a ship; they have to be sent back to the manufacture for refurbishment. The present invention facilitates repair and refurbishment on the deck of a ship as the elongate bundle can be removed from the strength termination and rerouted or replaced as necessary. Another disadvantage associated with the prior art epoxy termination is the fact that the epoxy termination is manufactured from steel, is significantly larger and heavier than the present invention. The added weight and length from the prior art epoxy termination tends to complicate the installation and requires additional buoyancy to lift the cobra head during installation.

The following references use the term "flying lead" in the title: U.S. Pat. No. 6,102,124 entitled "Flying Lead Workover Interface System;" U.S. Pat. No. 6,880,640 entitled "Steel Tube Flying Lead Jumper Connector" and U.S. Pat. No. 6,957,929 entitled "ingle and Dual Reel Flying Lead Deployment Apparatus" and U.S. Patent Publication No. 2007/0227740 entitled "Flying Lead Connector and Method for Making Subsea Connections," which are all incorporated herein by reference.

Sheathing in the prior art and the present invention is vented to the sea. The interior conduits used for the purpose of fluid transmission contain fluids that are near the density of water. This fact along with the dense materials used for construction of the elongate bundle and interior conduits make the elongate bundle negatively buoyant in both designs. This is a desirable attribute in both designs, as the elongate bundle tends to settle into the seafloor. However, there is a disadvantage associated with this feature in the prior art. The elongate bundle tends to coil and kink to a degree due to the stored energy in the bound composite structure. This can cause the elongate bundle to rise up above seafloor. These protrusions increase the risk of damage to the flying lead and other components during work-over and follow-on installation operations.

Prior art cobra head assemblies are fitted with an independent removable buoy or float which is attached to either end prior to deployment subsea or on the seafloor. The removable prior art buoy causes the cobra head and a small portion of the bend limiter assembly to become positively buoyant allowing the cobra head and the stab-plate to upright themselves from the seafloor. This gives the end of the flying lead a silhouette of a cobra in a striking stance, hence the name cobra head assembly. The buoyant element serves as an installation add for the ROV by reducing the weight of the cobra head. The present invention may be installed using smaller ROV's than comparably sized prior art flying leads for several reasons. First, a smaller sized buoyancy module may be used with the present invention because it is significantly lighter than prior art designs. Second, the present invention is more compact and has less stored energy in the elongate bundle.

An ROV bucket containing a ROV interlock interface and stab-plate locking mechanism is mounted to the rear of flying stab-plate. The bucket is operatively connected to a drive mechanism to draw the stab-plates together and lock them in place; the drive mechanism also provides a means of aligning during makeup. The ROV has a power arm with an integrated torque tool that engages the bucket and rotates the drive mechanism to engage and disengage the stab-plates, as is well known to those skilled in the art. Well known means of connecting stab-plates include a drive screw, collet couplings and tri-locks. Once the fixed and flying stab-plates are firmly connected, the ROV disconnects from the bucket and the ROV is free to "fly" to the other cobra head assembly or service other equipment on the seafloor.

During installation one ROV typically engages the ROV bucket on the flying stab-plate assembly and a second ROV stands off to observe the operation and provide feedback to the operator of the first ROV who is stationed on a surface vessel or surface platform. The first ROV is sometimes referred to as the "work ROV" and the second is sometimes referred to as the "observation ROV."

Prior art flying leads can be installed in one of two ways. The first method is referred to in the industry as the "Down Line Method." The second method was developed by Deep Down, Inc., the assignee of the present application, and involves the use of proprietary rigging sequences and an installation basket containing the flying lead which is lowered to the seafloor. The flying lead is deployed on the seafloor using an ROV with the aid of a surface crane.

Using the "Down Line Method," a removable sling with clump weight and removable guide wire are attached to either a) a D-ring on the two leg bridle attached to the frame or b) a pad eye contained in the flying stab-plate. A top side crane picks up the flying lead assembly from the guide wire and swings the assembly aft of the boat and lowers the assembly a fixed distance and releases the guide wire. The balance of the flying lead is restrained on either a compact vertical or horizontal drum which is speed and tension regulated to match the desired payout rate. While the flying lead is being lowered it is for all practical purposes is vertical in the water column.

During this part of the installation, the PVC over-hose in prior art designs tend to bunch up at the bottom end of the flying lead. This often breaks an over-hose splice or pulls the hose away from the second end. When the prior art flying lead has been paid out and the first end is lying on the seafloor, the second end is restrained and rigged to include a crane guide wire and removable buoyancy module. The second end is then lowered to the seafloor. Once at the seafloor, the second end will stand up due to the added buoyancy. This allows the ROV to "fly in," engage the ROV bucket, maneuver the flying stab-plate and mate with the fixed stab-plate on the subsea structure. Once the plates are engaged and locked, the ROV disengages from the ROV Bucket on the flying stab-plate and disconnects the buoyancy module. The ROV then flies the buoyancy module to the first end of the flying lead assembly, attaches it to the cobra head assembly and then disconnects the clump weight. Again, the head rises up and the ROV follows the same sequence to engage and lock the stab-plates together. The buoyancy is then removed and attached to the clump weight along with the crane guide wire for retrieval.

U.S. Pat. No. 6,880,640 is for a "Steel Tube Flying Lead Jumper Connector," which is incorporated herein by reference. Notwithstanding the title, the apparatus in the '640 Patent is installed using a ROV. There are structural differences between the apparatus in the '640 and the present invention. For example, the apparatus in the '640 patent does not have a bend limiter. The apparatus in the '640 patent does not have an over-hose that extends the full length of the interior conduits. The conduits of the '640 patent are bent into a predetermined "W" shaped midsection which can only expand laterally along the lay of "W" and only to a limited degree due to thermal expansion of the fluid conveyed. There is still a need for a flexible flying lead with improved cobra head assemblies.

SUMMARY OF THE INVENTION

Offshore oil production is extending into deeper and deeper water. An offshore field is often drilled in a cluster pattern and various types of subsea equipment are installed on the seafloor, as previously discussed. Umbilicals, jumpers and flying leads are used in subsea oil production. However, this invention is directed solely to flying leads and not to umbilicals or jumpers.

This invention will allow the design standardization, and improved serviceability of flying leads. The present invention will result in reduced manufacturing costs and shorter installation time when compared to prior art flying leads. The flying leads of the present invention include a) a pair of cobra head assemblies, b) a pair of bend limiter assemblies, and c) an elongate bundle extending between the bend limiter assemblies. Each cobra head assembly includes a universal frame assembly; an interchangeable interface plate to accept a variety of stab-plates from various vendors; a mechanical strength termination; a load bearing bend limiter connector for attachment of a bend limiter assembly; a two leg bridle assembly and optional buoyancy module.

If the optional buoyancy module is included, it will serve to protect the interior conduits and aid in installation of the flying lead. Installation of the present invention requires less rigging and fewer ROV operations to make the connection thereby reducing the installation time and risk of damage to the flying lead and surrounding structures. A load bearing bend limiter assembly is attached to each cobra head assembly.

The present invention includes non-constrained interior conduits which are surrounded by a loosely fitting elongate load bearing over-hose, each end of which is fitted with a load bearing over-hose connector. Each bend limiter assembly has the freedom to rotate about the frame making it easier to install the flying lead. The non-constrained interior conduits may be steel tubes, hydraulic hoses, electric cables, fiber optic cables, steel cables or any combination thereof. The fiber optic and/or electric cable(s) may be contained in either a hydraulic hose, a steel tube or a combination of the two.

The non-constrained interior conduits can occupy up to 80 percent of the inside cross sectional area of the over-hose to allow for both adequate radial and axial movement of the conduit elements with respect to each other. This unrestricted movement of conduits results in a much smaller bend radius approaching that of the stiffest element contained in the bundle. A smaller bend radius allows for a small storage reel and a smaller foot print on the installation vessel deck. A smaller bend radius allows the present invention to be installed by smaller ROVs.

The term "non-constrained" interior conduits as used herein means that there is no strapping, taping or banding of the interior conduits. The interior conduits are not wound in a helical fashion. The over-hose connectors engage the bend limiter assembly to prevent bunching of the over-hose, which prevents unwanted exposure of the interior conduits. This design prevents kinking and enables independent movement of the over-hose, the bend limiter segments and the frame with respect to each other. The load bearing bend limiter assemblies, load bearing over-hose connectors and load bearing over-hose are capable of transmitting loads of up to 10 tons to the frame. However, all that is necessary is that the flying lead will support its own weight if lifted vertically in the air.

BRIEF DESCRIPTION OF THE DRAWINGS

FIG. 12 is an isometric view of a floatation assembly installed on a cobra head assembly.

FIG. 13 is a section view of an alternative design for an over-hose connector assembly.

FIG. 14 is an alternative embodiment of the interface element for a stab-plate produced by Vetco® having 12 connection ports.

DETAILED DESCRIPTION OF THE INVENTION

Figure 1:
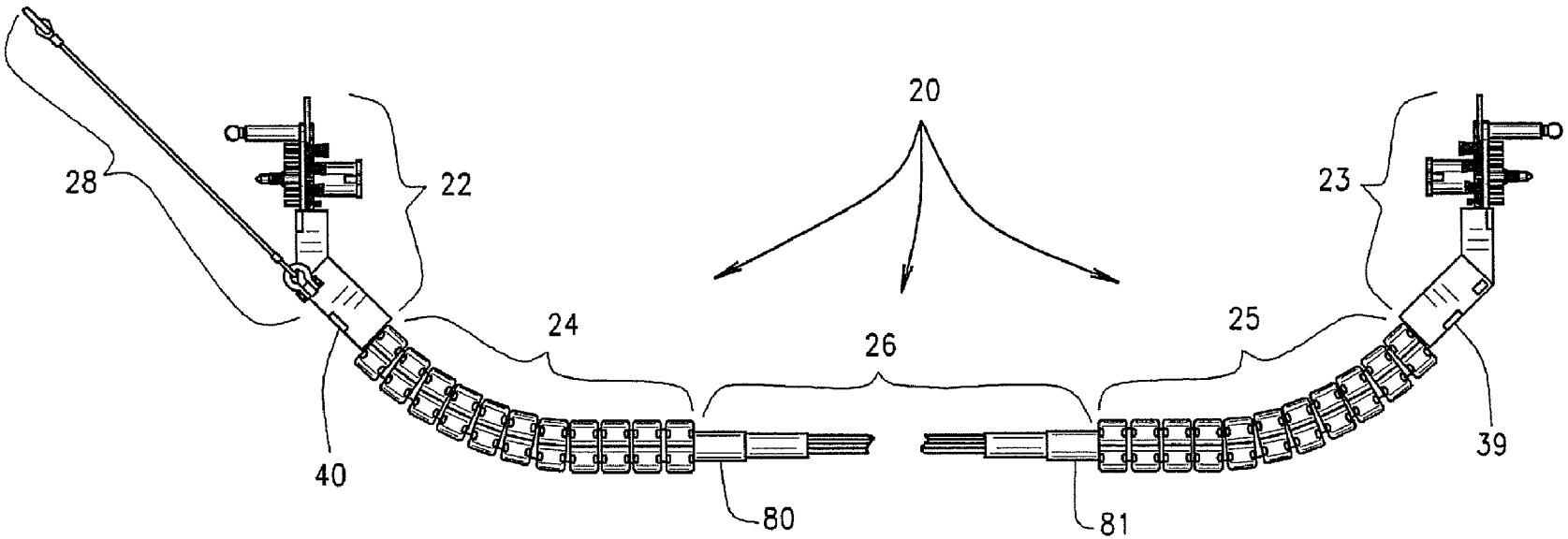
FIG. 1 is an isometric view of the loose tube flying lead.

Referring now to FIGS. 1, 2, 3, 4 and 7, the loose tube flying lead assembly is generally identified by the numeral 20. The loose tube flying lead assembly includes the following subassemblies: a first cobra head assembly generally identified by the bracket 22, and a second cobra head assembly generally identified by the bracket 23, a first bend limiter assembly generally identified by the bracket 24, a second bend limiter assembly, generally identified by the bracket 25, an elongate bundle assembly generally identified by the bracket 26, a first bridle assembly generally identified by the bracket 28 and a second bridle assembly. The first bridle assembly 28 connects to the first cobra head assembly 22 which connects to the first bend limiter assembly 24 which connects to the bundle assembly 26, as best seen in FIG. 1.

The opposite end of the elongate bundle assembly connects to the second bend limiter assembly 25, the second cobra head assembly 23 and a second bridle assembly. The second cobra head assembly 23 is a mirror image of the first cobra head assembly 22. The second bend limiter assembly 25 is a mirror image of the first bend limiter assembly 25.

The apparatus of FIG. 1 actually includes two bridal assemblies. The first bridal assembly 28 is attached to the first cobra head assembly 22 and the second bridal assembly is not shown due to space limitations in the drawings. The two bridle assemblies are mirror images of each other. In combination, the bridal assembly 28, the cobra head assembly 22 and the bend limiter assembly 24 will support about 10,000 pounds of dead weight, if suspended vertically in the air.

Figure 2:
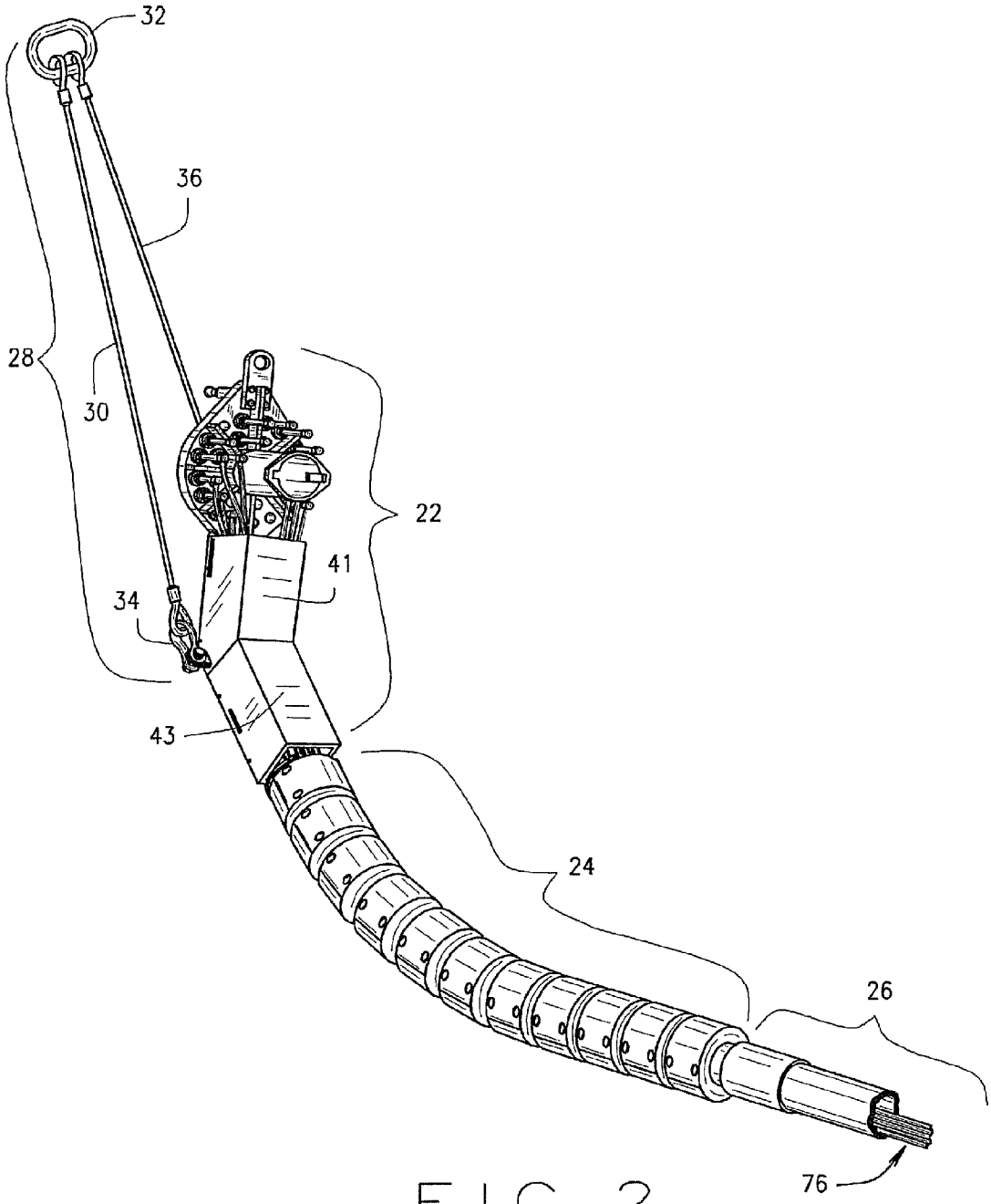
FIG. 2 is a isometric view of a cobra head assembly, a bend limiter assembly, a portion of the elongate bundle and a topside bridle.
Figure 3:
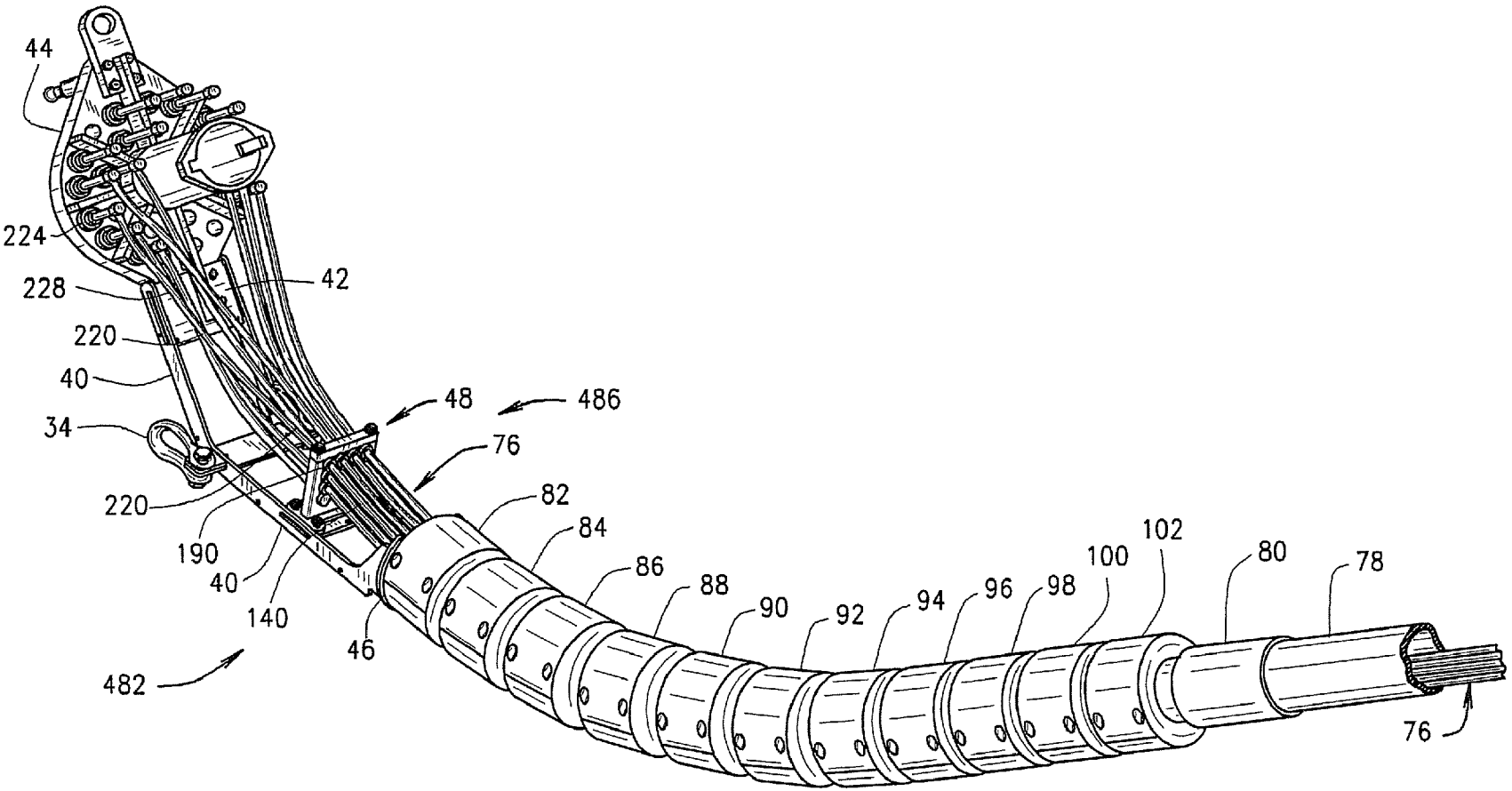
FIG. 3 is an isometric view similar to FIG. 2 with the bridle and the covers of the cobra head assembly removed. A Vetco® stab-plate is shown with 24 connection ports.
Figures 4, 5:
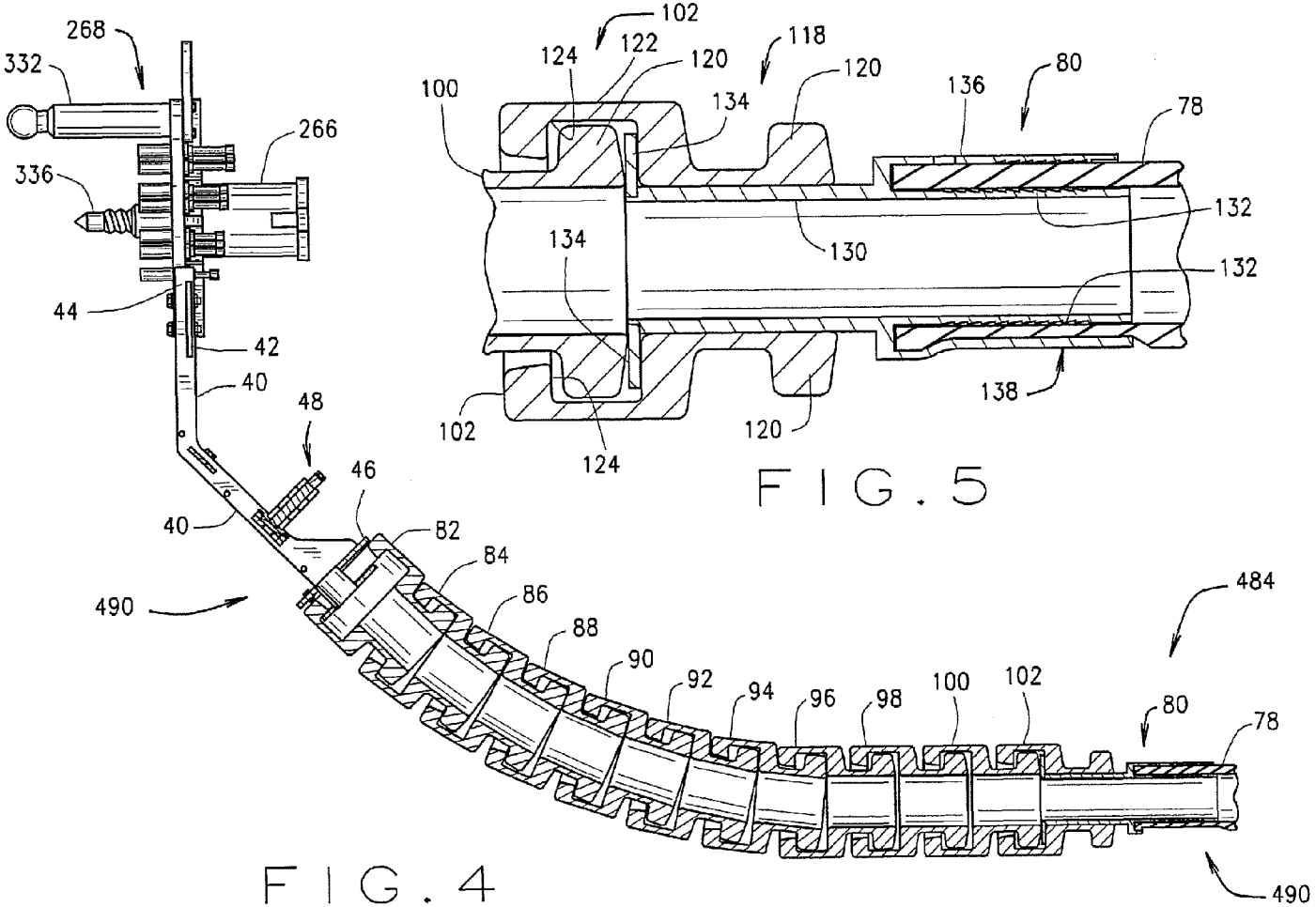
FIG. 4 is a partial section view of the apparatus in FIG. 3 with the interior conduits removed.
FIG. 5 is an enlarged section view of the over-hose connector assembly and a portion of the bend limiter.

The bridle assembly 28 includes a first cable 30 attached on one end to a D-ring 32 and on the other end to a shackle 34. The bridle assembly further includes a second cable 36 attached on one end to the D-ring and on the other end to a second shackle, not shown. The cobra head assembly includes a universal frame 40, and an interchangeable interface element on one end of the universal frame to secure the stab-plate. In FIGS. 1 and 2 the frame is shrouded by a first cover segment 41 and a second cover segment 43. In FIGS. 3 and 4 the covers have been removed to better reveal the construction of the apparatus.

Figure 7:
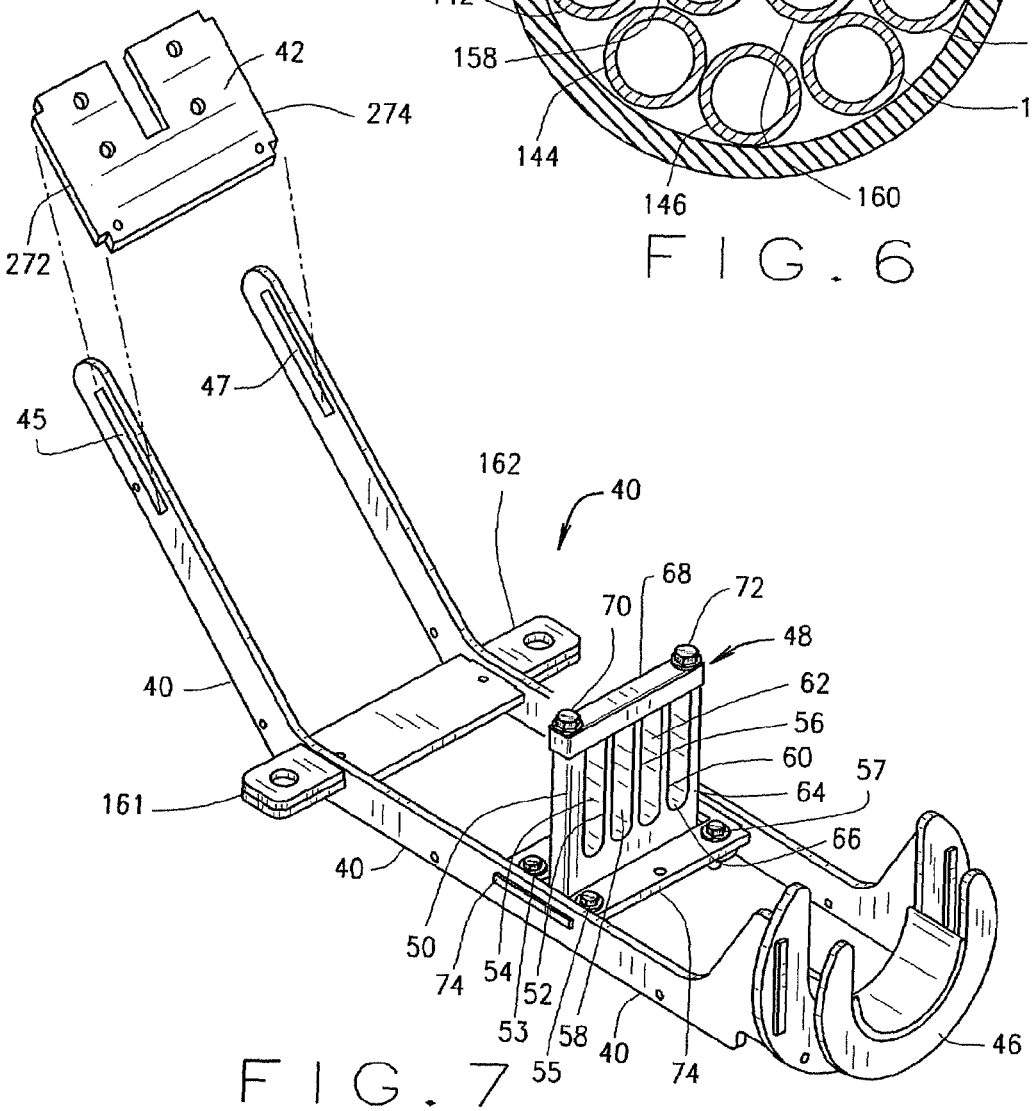
FIG. 7 is an isometric view of the universal frame. The interface element in this view is designed to support a Vetco® stab-plate with 24 connection ports.

The frame 40 is referred to as "universal" because different styles of interface elements may be used to attach different brands of stab-plates to the frame 40 all better seen in FIGS. 7 and 7A. On the other end of the universal frame is a bend limiter adapter 46. In between the interface element and the bend limiter adapter, on the universal frame, is an interior conduit termination assembly, better seen in FIG. 7.

Figure 11:
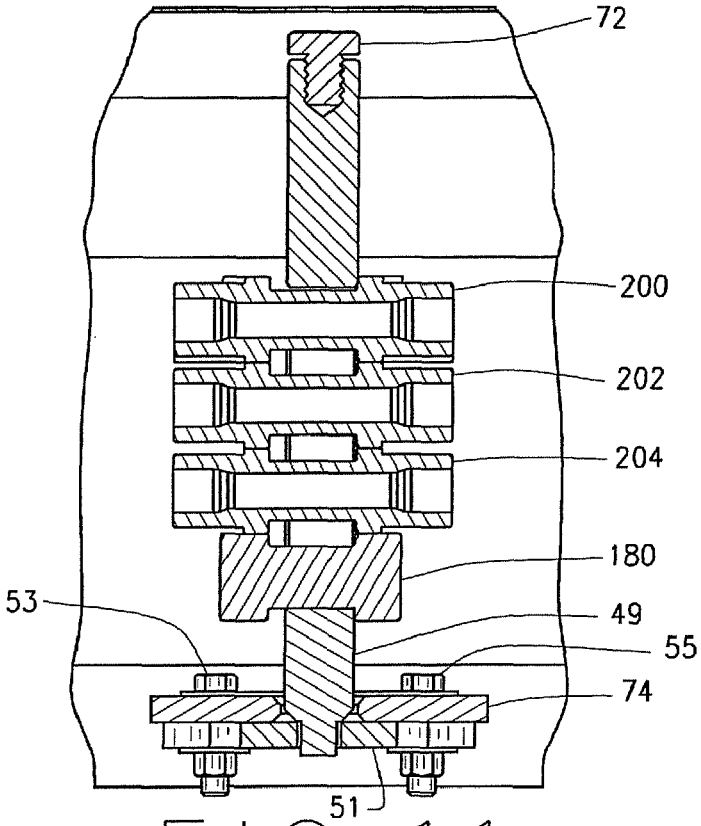
FIG. 11 is a section view along the line 11-11 of FIG. 8.

The interior conduit termination assembly 48, best seen in FIG. 11 includes a vertical member 49 and a horizontal member 51 which are welded together from two separate pieces or may be fabricated from a single piece. The interior conduit termination assembly 48 is removable from the frame 40 and slips through the support plate 74 from the bottom. The horizontal member and the support plate are connected by a plurality of nuts and bolts, 53, 55, 56, and 57 or other suitable fastening means.

Figure 8:
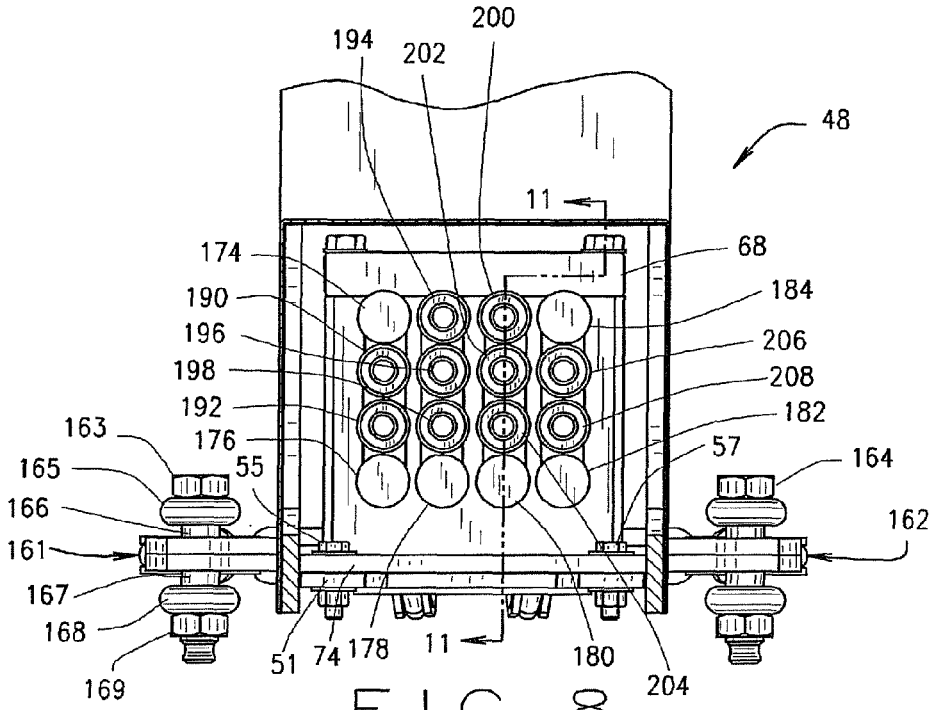
FIG. 8 is an end view of the conduit termination assembly.

Referring now to FIGS. 7, 8 and 11, the interior conduit termination assembly includes a first finger 50 and a second finger, 52 which define a first gap 54; a third finger 56 which in combination with the second finger defines a second gap 58; a fourth finger 60 which in combination with the third finger defines a third gap 62 and a fifth finger 64 which in combination with the fourth finger defines a fourth gap 66. A locking bar 68 is attached to the first finger by first bolt 70 and the fifth finger by a second bolt 72. The interior conduit termination assembly is attached to the universal frame with a support plate 74.

The elongate bundle includes a plurality of non-constrained elongate interior conduits generally identified by the numeral 76 which are surrounded by the elongate over-hose 78. FIGS. 1, 2, and 3 include the plurality of non-constrained elongate interior conduits, but these interior conduits have been omitted from FIG. 4 for clarity. One end of the over-hose is connected to an load bearing over-hose connector 80 and the other end is likewise connected to a second load bearing over-hose connector 81. Both over-hose connectors are mirror images of each other.

The bend limiter assembly includes a plurality of bend limiter elements including first bend limiter element 82, second bend limiter element 84, third bend limiter element 86, fourth bend limiter element 88, fifth bend limiter element 90, sixth bend limiter element 92, seventh bend limiter element 94, eight bend limiter element 96, ninth bend limiter element 98, tenth bend limiter element 100 and eleventh bend limiter element 102. Each of the bend limiter elements are mirror images of the others. Bend limiter assemblies have about 10 to about 14 elements and limit the bend radius to about 45° as better seen in FIG. 4.

The first bend limiter element 82 engages the bend limiter connector 46 on the universal frame 40. The connections between the cobra head assembly 22, the bend limiter assembly 24, the over-hose 78, the second bend limiter assembly 25 and the second cobra head assembly 23 allow all of these components to rotate freely and independently of each other. The last bend limiter 102 engages the over-hose connector 80 as better seen in FIG. 5. The universal frame rotates independently of the over-hose connector 80 and the elongate over-hose 78.

Each bend limiter element is formed in two halves, a top half 110 and a bottom half 112. These two halves are held together by a first screw 114, a second screw 116, a third screw, not shown and a fourth screw, not shown. Each bend limiter element has a rear section 118, better seen in FIG. 4, which forms a radial rear flange 120 and a forward section 122 which forms a receptacle 124 sized and arranged to receive the radial rear flange of the next bend limiter element. There is sufficient clearance between the radial rear flange 120 and the receptacle to allow the bend limiters to freely bend to a predetermined bend radius that does not exceed the bend radius of the plurality of interior conduits. Each bend limiter element also rotates freely of the other bend limiter elements.

FIG. 5 is an enlarged section view of the over-hose connector 80 and a portion of the bend limiter. The over-hose connector includes a conduit 130 which forms a hose barb 132 on one end and a front radial flange 134 on the other end. A circular fitting 136 surrounds the over-hose 78 and the hose barb 132 as shown in the top portion of FIG. 5. The circular fitting is swaged around the over-hose to securely connect the over-hose to the over-hose adapter as shown in the lower portion 138 of FIG. 5.

Figure 6:
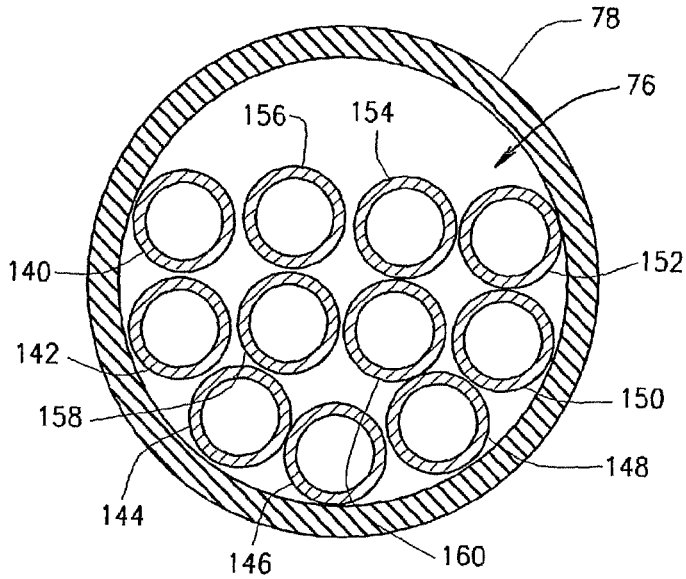
FIG. 6 is an enlarged section view of the over-hose and the plurality of interior conduits.

FIG. 6 is an enlarged section view of the over-hose 78 and the plurality of interior conduits 76. FIG. 6 is merely illustrative of the interior conduits, the exact number of which may vary. In this illustration there is first interior conduit 140, second interior conduit 142, third interior conduit 144, fourth interior conduit 146, fifth interior conduit 148, sixth interior conduit 150, seventh interior conduit 152, eight interior conduit 154, ninth interior conduit 156, tenth interior conduit 158 and eleventh interior conduit 160. The non-constrained interior conduits 140-160 occupy from about 75 percent to about 85 percent of the inside cross sectional area of the over-hose, and optimally about 80 percent. The interior conduits may be formed from ½ inch id ⅝ inch of steel tubing, thermoplastic tubing, fiber optic cable and/or electric power cables. In the case of steel tubes, the industry typically uses 2507 super duplex stainless steel tubing for flying leads. Other types and sizes may also be suitable for the interior conduits.

"Maxtra Liquid Mud Hose," an off the shelf product, is suitable for use as the over-hose 78 in the present invention. Conventionally, Maxtra hose is used for transporting drilling mud between barges and drilling platforms. Maxtra Liquid Mud Hose, model number "1C11M-400 Maxtra Cord" can be purchased from Max Coupling and Hose Corporation located in Houston, Tex. www.maxcoupling.com. Other hoses may also be suitable for use in this application. The over-hose may be produced from a material that is UV stabilized and resistant to chemical attack. The over-hose may be flexible and radially rigid. The over-hose must also have sufficient axial strength to support its weight during installation. For this reason, it is sometimes referred to as load bearing over-hose.

Referring to FIG. 7, the universal frame is generally identified by the number 40. The interface element 42 is suitable for use with the Vetco® stab-plate with 42 connection ports. In the alternative, the interface element 388, better seen in FIG. 14, is suitable for use with the Vetco® stab-plate with 12 connection ports. This alternative interface element fits in the slot 45 and an opposing slot 47. The interface element is then welded in place on the universal frame 40. The interface element and the frame form a universal mounting assembly that is suitable for many different types of stab-plates. Other alternative embodiments of the interface element are shown in FIGS. 15-19. The bend limiter adapter 46 is formed on the end of the frame opposite the interface element and connects to the first bend limiter element 82, better seen in FIG. 4. The interior conduit termination assembly 48 is shown without any spools in this figure. In the next figure the interior conduit termination assembly 48 is shown full of spools.

FIG. 8 is an end view of the interior conduit termination assembly 48. The spools are attached to the universal frame 40 by the interior conduit termination assembly 48. The spools may be blank, such as blank spools 174, 176, 178, 180, 182 and 184. The spools may also be hollow such as hollow spools 190, 192, 194, 196, 198, 200, 202, 204, 206 and 208. The purpose of the hollow spools is to connect the plurality of interior conduits to the universal frame. The purpose of the blank spools is to fill all the gaps 54, 58, 62 and 66 between the fingers 50, 52, 56, 60 and 64 in the interior conduit termination assembly. (Better seen in the preceding figure) In this fashion, there is no shifting around because all of the spaces in the gaps are full of hollow and/or blank spools as shown in FIG. 8. In some embodiments, all of the gaps may be filled with hollow spools not shown.

A first bridle support 161 and a second bridle support 162 extend from opposite sides of the universal frame 40. Holes, not shown in this figure, are formed in the supports 161 and 162. A first bolt 163 penetrates the hole in the first bridle support 161 and a second bolt 164 penetrates the hole in bridle support 162. Hardware is stacked in uniform fashion around the first bolt and the second bolt to facilitate attachment of the shackles, better seen in FIG. 3. The first bolt 163 is stacked from the top as follows: a first shackle element 165 is positioned under the bolt head, a first spacer 166 is positioned between the first shackle element and the first bridle support 161. The first bolt 161 is stacked from the bottom as follows: a nut 169 is threaded on the bottom of the bolt, a second shackle element 168 is positioned above the nut and a second spacer 167 is positioned between the second shackle element and the bottom of the first bridle support 161. In similar fashion, the second shackle is attacked to the second bridle support 162.

Figure 9:
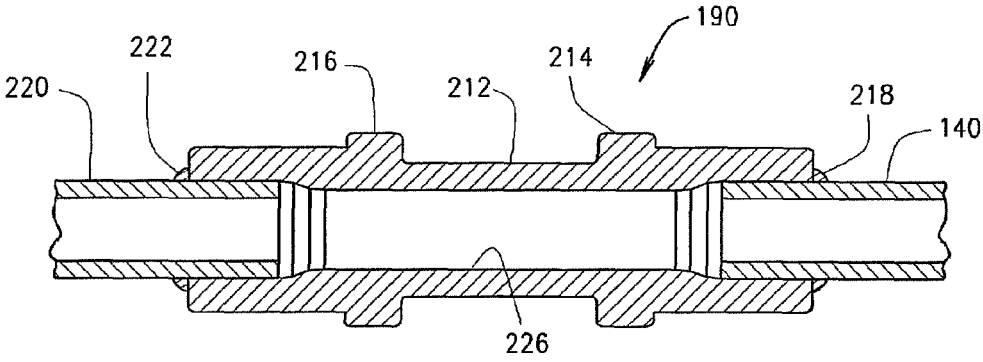
FIG. 9 is a section view of a hollow spool and an interior conduit.

FIG. 9 is a section view of a hollow spool 190 and an interior conduit 140. A barrel 212 forms a first radial flange 214 on one end and a second radial flange 216 on the other end of the spool. The barrel is sized and arranged to slip into the gaps in the interior conduit termination assembly. The first radial flange and the second radial flange are sized to engage the fingers of the interior conduit termination assembly. The spools are held in place in the interior conduit termination assembly by the locking bar 68. One end of the elongate interior conduit 140 is permanently attached to the spool 190 by weld 218. A first end of an elongate conduit extension 220 is secured to the spool 190 by weld 222. A space 226 may be formed between the end of the conduit 140 and the end of the conduit extension 220.

The second end 228 of the conduit extension is attached to a coupling 224, better seen in FIG. 3. The coupling 224 fits in the stab-plate 44. Stab-plates, are off the shelf products currently sold by a number of different vendors, including but not limited to: Unitech Offshore AS located in Bergen, Norway, www.unitechoffshore.com; Oceaneering International, Inc. of Houston, Tex., www.oceaneering.com; FMC Technologies located in Houston, Tex., www.fmctechnologies.com; Aker Solutions, ASA also known as Aker Kvaerner Subsea located in Houston, Tex., www.akersolutions.com; Subsea 7 located in the UK, www.subsea7.com and Vetco Gray, a GE Oil & Gas Company located in Nailsea, UK www.geoilandgas.com. The aforementioned vendors generally produce three different types of connectors: stab-plates, ROV connectors and diver connectors, which are well known to those skilled in the art. Stab-plate type connectors are shown in FIGS. 1-4 and ROV type connectors are shown in FIGS. 23-26.

The stab-plates contain hydraulic, electric and optical couplings. Hydraulic couplings are off the shelf products currently sold by a number of different vendors, including but not limited to: National Coupling Company, Inc. located in Houston, Tex., www.nationalcoupling; Walther-Prazision located in Haan, Germany, www.walther-praezision.de. Electric and optical couplings are off the shelf products, currently sold by a number of different vendors, including but not limited to: Ocean Design, Inc., a Teledyne Company located in Daytona Beach, Fla., www.odi.com; Tronic, a division of the Expro Group located in Ulverston, UK, www.exprogroup.com; Gismo located in Neumuenster, Germany, www.gismaconnectors.de; Deacon Brantner & Associates, Inc. located in El Cajon, Calif., www.seaconbrantner.com; Compagnie Deutsch located in Rueil Malmaison, France, www.compagnie-deutsch.com.

Figure 10:
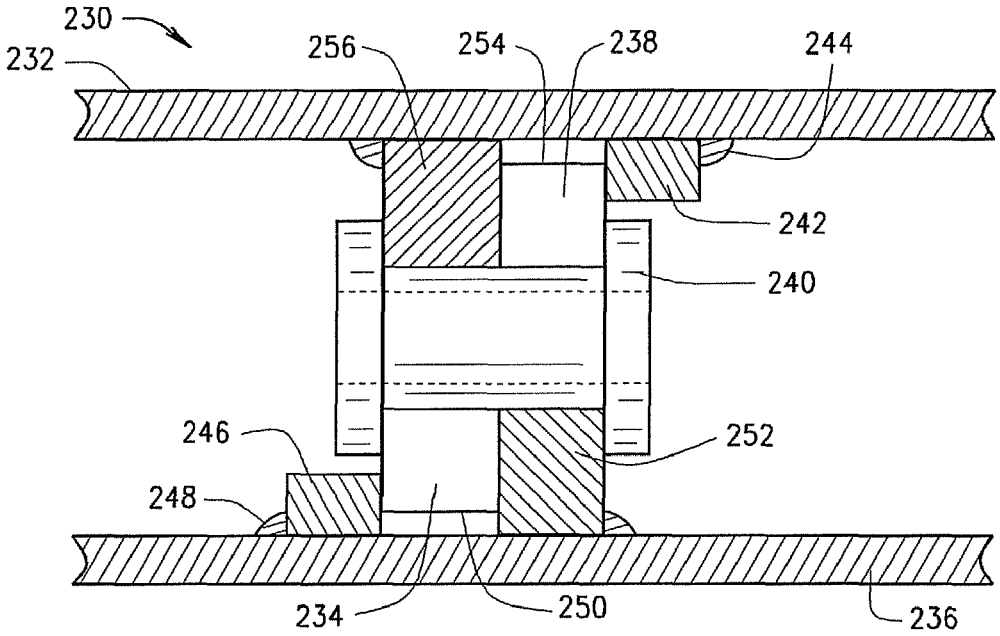
FIG. 10 PRIOR ART
FIG. 10 is a section view of a prior art interior conduit termination assembly produced by the assignee of the present application.

FIG. 10 is a section view of a prior art interior conduit termination assembly generally identified by the numeral 230. A plurality of fingers extends from an upper cover 232.

One upper finger 234 is shown in this figure. A plurality of lower fingers extends from a frame 236. One lower finger 238 is shown in this figure. A hollow spool 240 is captured between the upper finger 234 and the lower finger 238. This figure is for illustrative purposes only. The actual prior art device contained a plurality of spools. An upper block 242 is connected to the upper cover 232 by weld 244 and lower weld 248. The upper support block serves to capture the tip 254 of the lower finger between the upper support block 242 and the base of the upper finger. The lower support block 246 serves to capture the tip 250 of the upper finger between the lower support block and the base 252 of the lower finger. In this fashion all of the spools were held between the upper cover 232 and the frame 236 of this prior art cobra head assembly. This prior art interior conduit termination assembly 230 was weaker and more cumbersome to fabricate and assembly than the interior conduit termination assembly 48 of the present invention, better seen in FIG. 8.

FIG. 12 is an isometric view of a floatation module generally identified by the numeral 258 installed on a cobra head assembly, not shown. The flotation module includes a first portion 260 and a second portion 262 connected by a plurality of cross bolts 287-299, 310 and 311. The flotation modules may be formed from syntactic foam, such as that produced by Flotation Technologies, Inc. of Biddeford, Me., a sister company to assignee. Several bend limiter elements, 82, 84, 86, 88, 90, 92, 94, 96, 98 and 100 extend from the bend limiter connector, not shown. The floatation module eliminates the need for prior art detachable floats. The ROV bucket 266 is connected to an Oceaneering stab-plate 267. Stab-plates from other vendors may also be attached to the universal frame 40, not shown in this figure.

FIG. 13 is a section view of an alternative design for an over-hose connector assembly 420. The concept is the same as the over-hose connector assembly 80 in FIG. 5. The over-hose 78 needs to be connected to the bend limiter assembly 24. The over-hose connectors 420 and 80 allow the over-hose 78 to rotate independently of the bend limiter assembly 24 and the cobra head assembly 22. This added flexibility makes it easier for the ROV to install the loose tube flying lead assembly.

The over-hose connector assembly 420 includes a conduit 422, one end of which forms a hose barb 424 and the other end forms a front terminal flange 426. In between the hose barb and the front terminal flange, the conduit forms a intermediate radial flange 428 that abuts the end of the over-hose 78. A plurality of hose bands 430, 432 and 434 secure the over-hose to the hose barb.

Referring to FIG. 14, the interface element 388 is designed to support a Vetco® 12 port stab-plate. The element 338 has eight holes, 392, 394, 396, 398, 400, 402, 404, and 406 sized and arranged to engage the Vetco® stab-plate. The interface element is designed to be easily installed in the universal frame 40 in place of interface element 42. Interface element 42, in FIG. 7 is designed to secure the Vetco® 24 port stab-plate to the universal frame 40. Interface element 388 in FIG. 7 is designed to secure the Vetco® 12 port stab-plate to the universal frame 40. A number of other stab-plates are produced by different vendors, such as Oceaneering. Other interface elements, not shown may be easily fabricated and installed in the universal frame 40.

Figure 15:
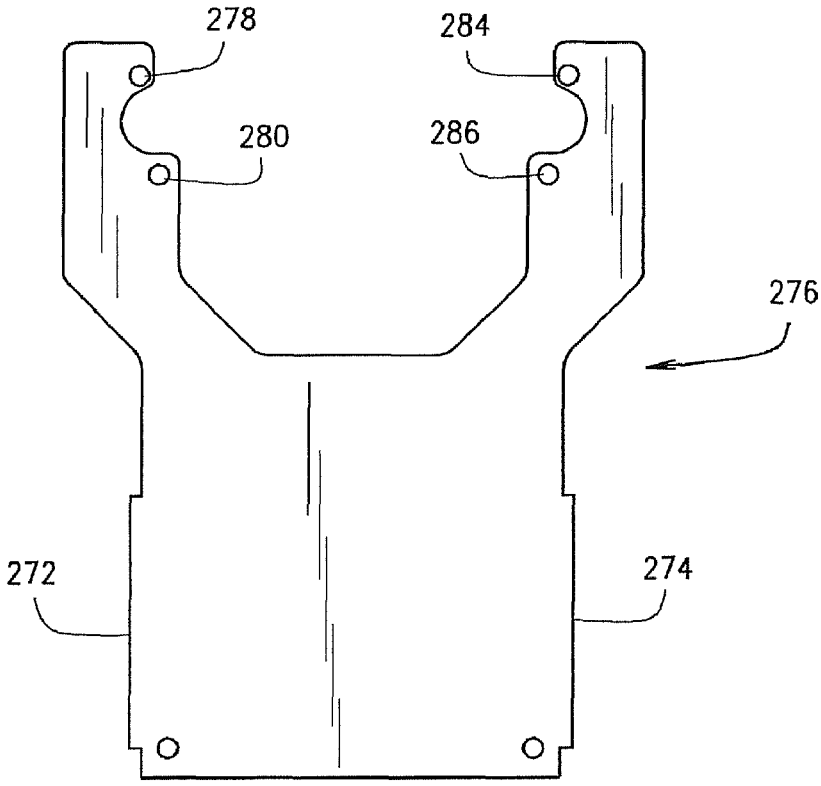
FIG. 15 is an alternative embodiment of the interface element for a stab-plate produced by FMC® Technologies.

FIG. 15 is an alternative embodiment 276 of the interface element for a stab-plate produced by FMC® Technologies, not shown. The interface element 276 has a left lug 272 sized and arranged to engage the left slot 45 in the universal frame 40. The interface element 276 also has a right lug 274, sized and arranged to engage the right slot 47 in the universal frame 40. The interface element 276 has a plurality of holes 278, 280, 284 and 886 sized and arranged to engage the FMC stab-plate, not shown.

Figure 16:
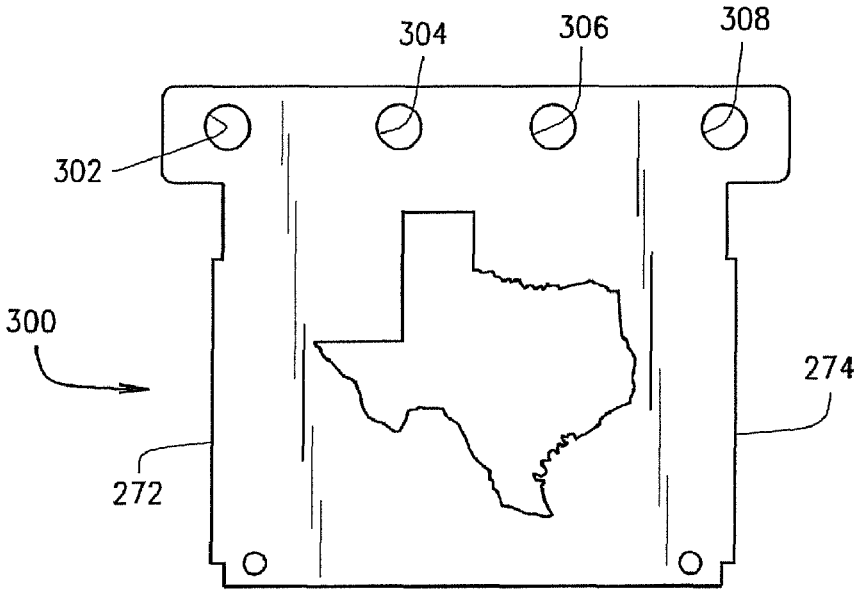
FIG. 16 is an alternative embodiment of the interface element for a stab-plate produced by Unitech.

FIG. 16 is an alternative embodiment 300 of the interface element for a stab-plate produced by Unitech, not shown. The interface element 300 has a left lug 272 sized and arranged to engage the left slot 45 in the universal frame 40. The interface element 300 also has a right lug 274, sized and arranged to engage the right slot 47 in the universal frame 40. The interface element 300 has a plurality of holes 302, 304, 306 and 308 sized and arranged to engage the Unitech stab-plate, not shown.

Figure 17:
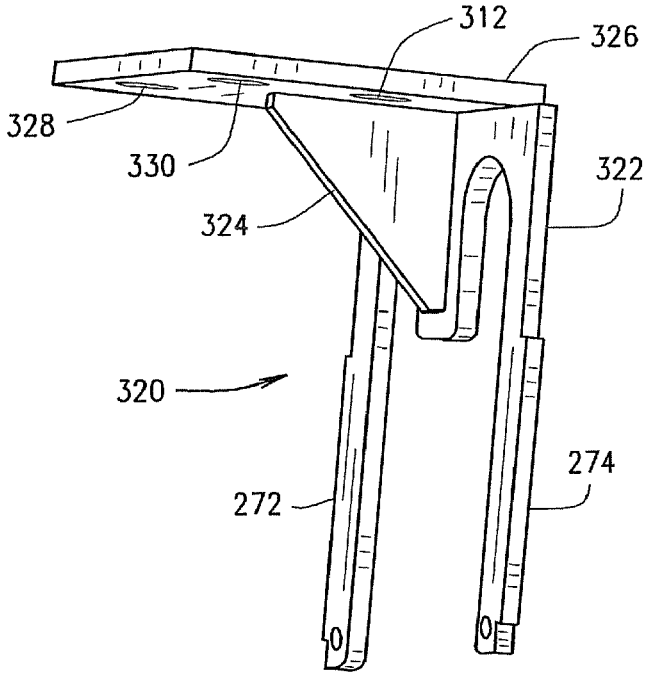
FIG. 17 is an alternative embodiment of the interface element for a stab-plate produced by Oceaneering.
Figure 18:
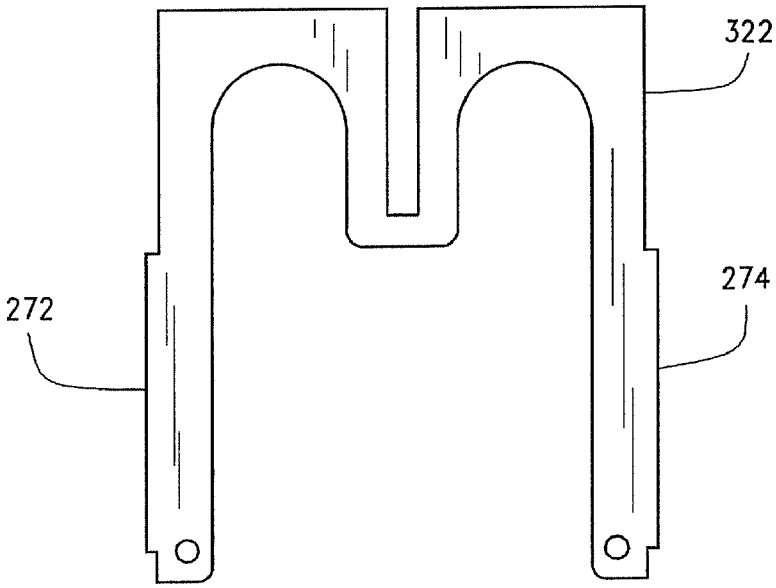
FIG. 18 is an enlargement of one component of the interface element of FIG. 17.

FIG. 17 and 18 is an alternative embodiment 320 of the interface element for a stab-plate produced by Oceaneering, not shown. The interface element 320 may be fabricated as a single component, or for simplicity it may be fabricated from three components, 322, 324, and 324. The interface element 320 has a left lug 272 sized and arranged to engage the left slot 45 in the universal frame 40. The interface element 320 also has a right lug 274, sized and arranged to engage the right slot 47 in the universal frame 40. The interface element has a plurality of holes 328, 330 and 332 and a fourth hole, not shown, sized and arranged to engage the Oceaneering stab-plate, not shown.

Figure 19:
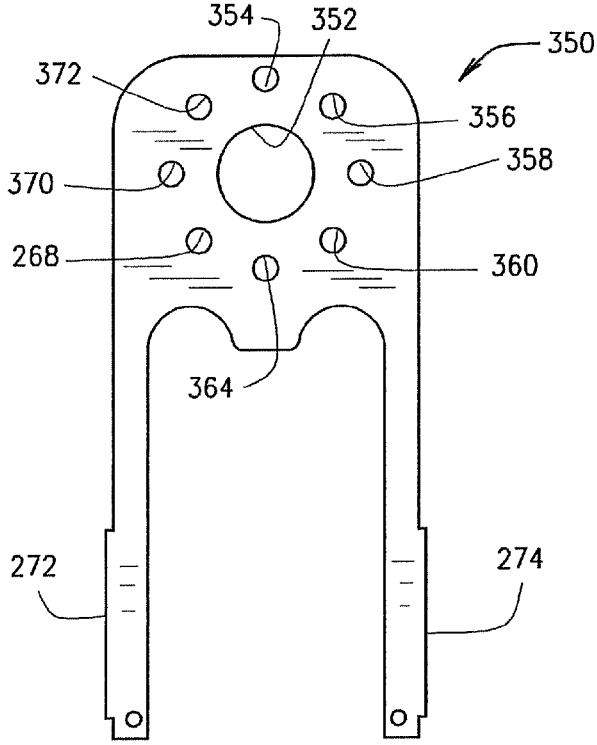
FIG. 19 is an alternative embodiment of the interface element for a stab-plate produced by Aker Kvaerner Subsea.

FIG. 19 is an alternative embodiment 350 of the interface element for a stab-plate produced by Aker Kvaerner Subsea. The interface element 350 has a left lug 272 sized and arranged to engage the left slot 45 in the universal frame 40. The interface element 350 also has a right lug 274, sized and arranged to engage the right slot 47 in the universal frame 40. The interface element 350 has a number of holes 352, 354, 356, 358, 360, 364, 368, 370, and 372 sized and arranged to engage the Aker Kvaerner stab-plate, not shown.

Figure 20:
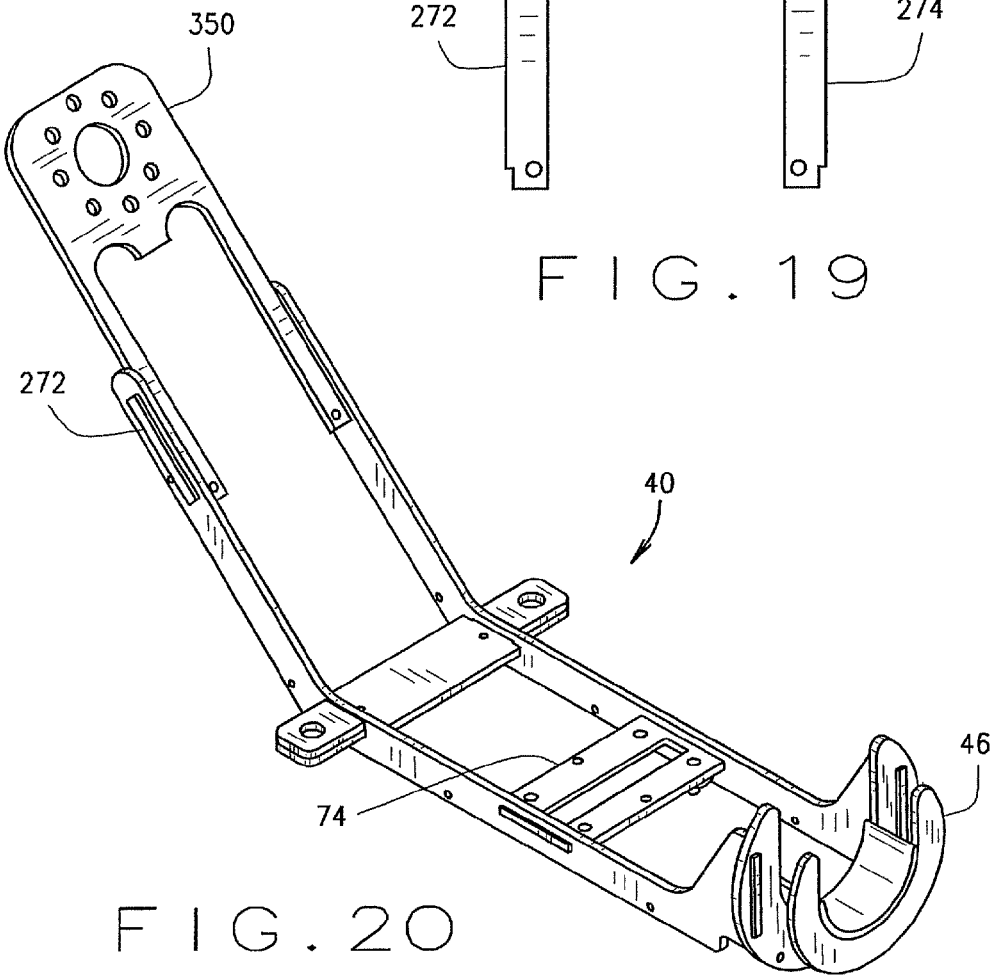
FIG. 20 is an isometric view of the universal frame with the interface element of FIG. 19.

FIG. 20 is an isometric view of the universal frame 40 with the interface element 350 of FIG. 19. The frame 40 includes a bend limiter connector 46 on the end of the frame opposite the interface element 350. In between the interface element and the bend limiter is the interior conduit termination assembly 48, only a portion of which is shown in this drawing.

Figure 21:
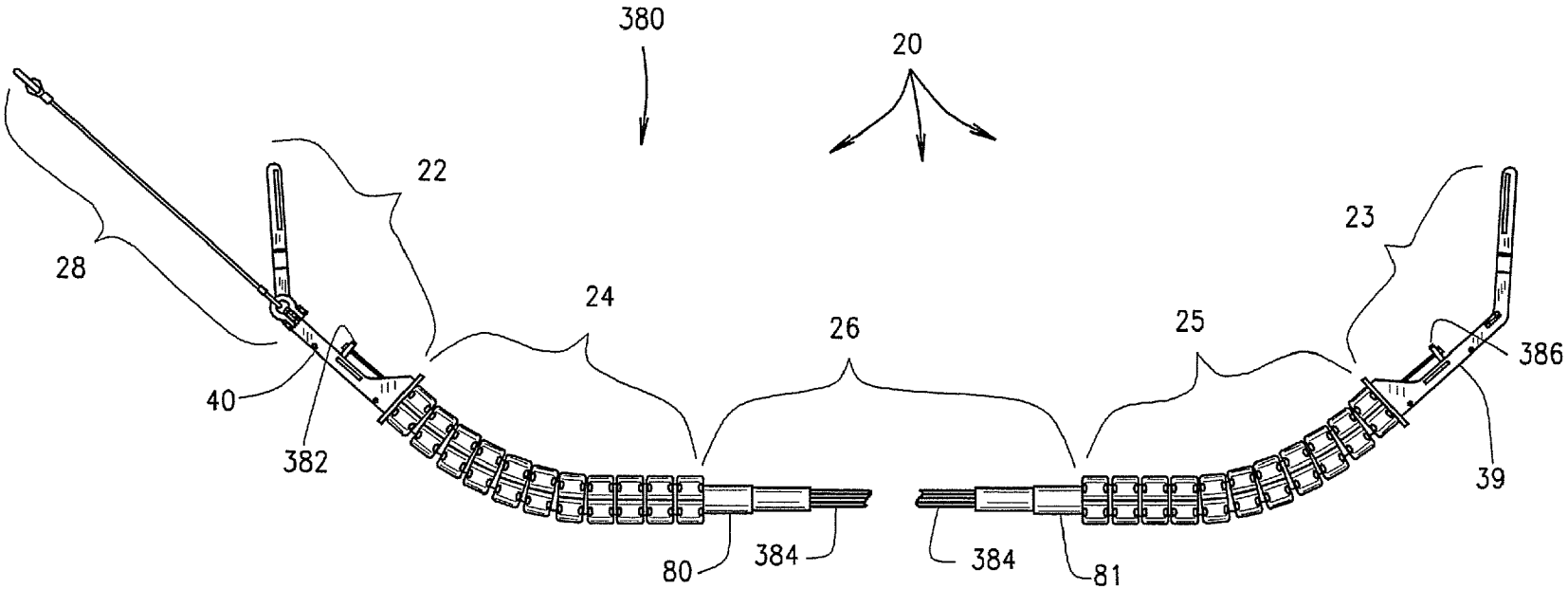
FIG. 21 is an isometric view of the first alternative embodiment of the loose tube flying lead with a load bearing wire rope termination assembly.
Figure 22:
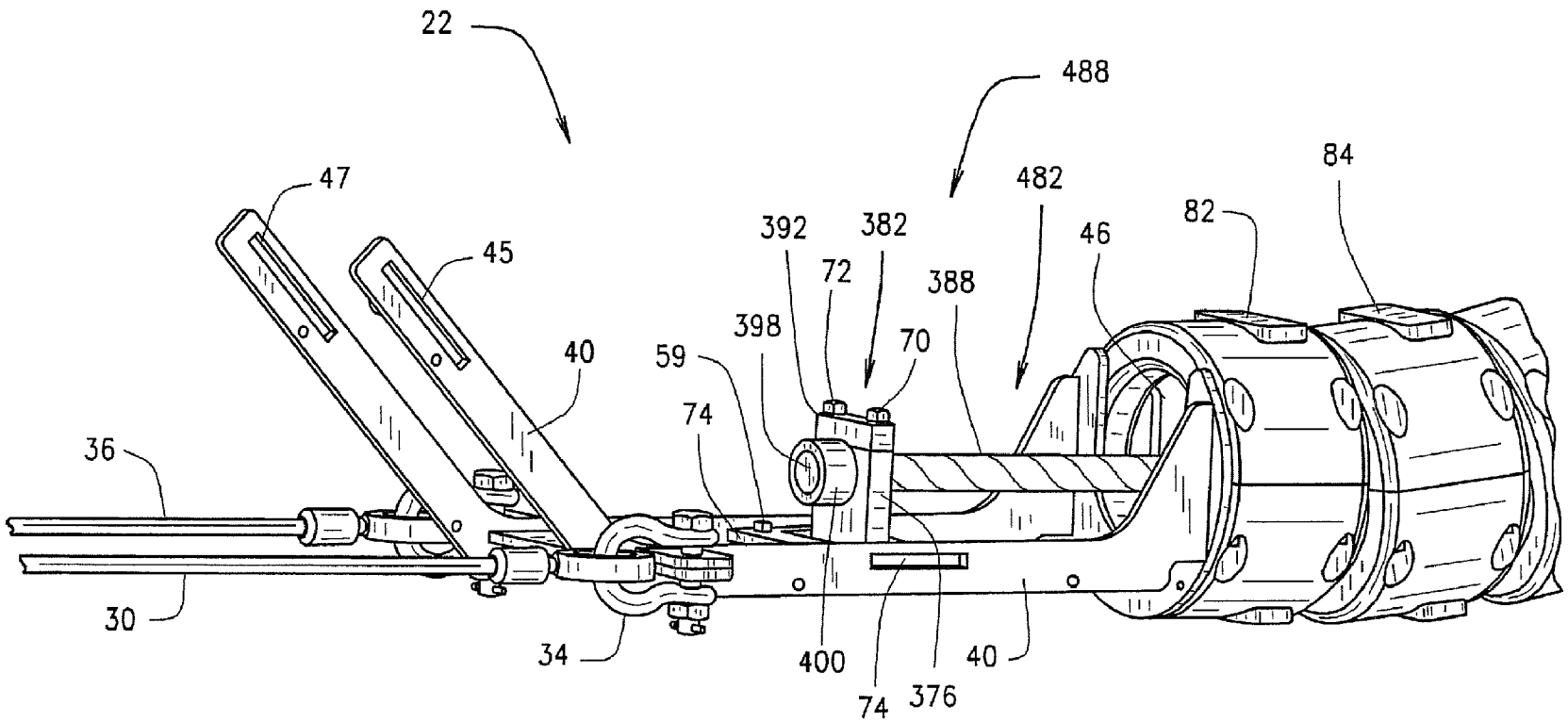
FIG. 22 is an enlargement of one cobra head assembly of FIG. 21 with a load bearing wire rope termination assembly.

FIG. 21 is an isometric view of the first alternative embodiment 380 of the loose tube flying lead assembly with a load bearing wire rope termination assembly 382. FIG. 22 is an enlargement of one cobra head assembly 22 of FIG. 21 showing the load bearing wire rope termination assembly 382 in greater detail. There are two primary differences between the loose tube flying lead assembly 1 and the first alternative embodiment 380 shown in FIGS. 21 and 22. First, the alternative embodiment 380 includes a wire rope termination assembly 382 instead of the interior conduit termination assembly 48. Second, the alternative embodiment 380 is designed to be used primarily with thermoplastic hoses 384 as interior conduits instead of steel tubing. These thermoplastic hoses connect direct to the stab-plate.

The apparatus of FIG. 21 actually includes two bridal assemblies, although only one is shown in the drawing. The first bridal assembly 28 is attached to the first cobra head assembly 22 and the second bridal assembly is not shown due to space limitations in the drawing. The two bridle assemblies are mirror images of each other. In combination, the bridal assembly 28, the cobra head assembly 22 and the bend limiter assembly 24 will support about 10,000 pounds of dead weight, if suspended vertically in the air. The other bridal assembly, not shown has similar strength capacities.

A wire rope 388 extends from the first wire rope termination assembly 382 in the first cobra head assembly 22 to the second wire rope termination assembly 386 in the second cobra head assembly 23. Each wire rope termination assembly is formed from a vertical element 376 and a horizontal element, not shown. The wire rope termination assembly may be formed from two separate pieces or a single element. The wire rope termination assemblies are removable and slip through the frame from the bottom similar to the interior conduit termination assembly 48. The wire rope termination assemblies are connected to the support plate 74 by a plurality of nuts and bolts, 53, 55, 57 and 59 or other connecting means, like the interior conduit termination assembly.

Each wire rope termination assembly includes a terminal 90 secured to a support plate 74 which is secured to the frame 40. The terminal has a cutout, not shown, sized and arranged to receive the wire rope 88. The lock bar is secured to the terminal by a first screw 94 and a second screw 96 or other suitable securing means. The first end 398 of the wire rope is attached to a circular lug 400. The circular lug 400 and the lock bar 392 prevent the wire rope 388 from slipping out of the first wire rope termination assembly 382. The second wire rope termination assembly 383 is a mirror image of the first wire rope termination assembly and will not be described in detail for the sake of brevity.

Figure 23:
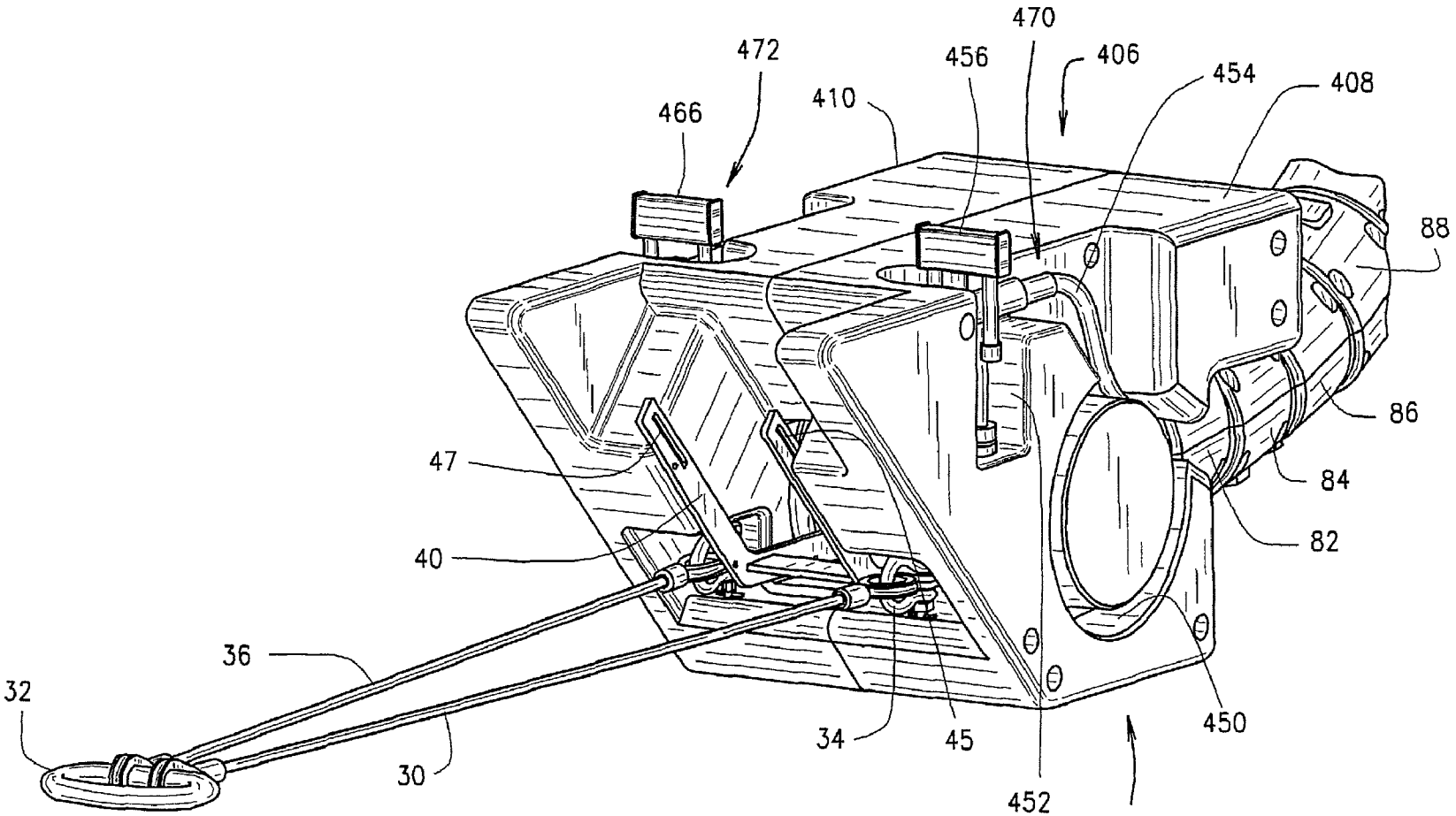
FIG. 23 is an isometric view of the second alternative embodiment of the loose tube flying lead with specialized buoyancy module.
Figure 24:
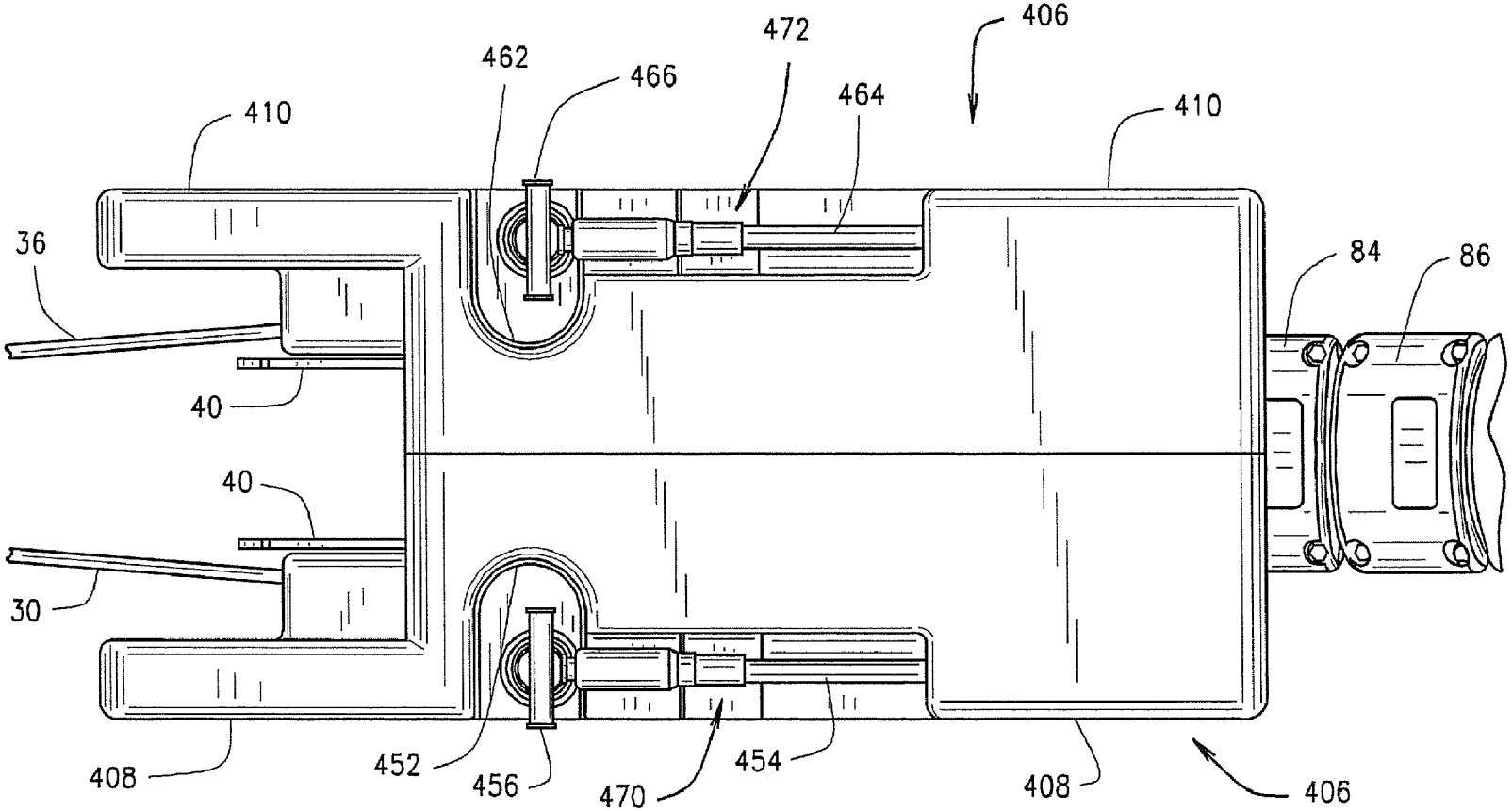
FIG. 24 is a top view of the second alternative embodiment of the loose tube flying lead with specialized buoyancy module of FIG. 23.
Figure 25:
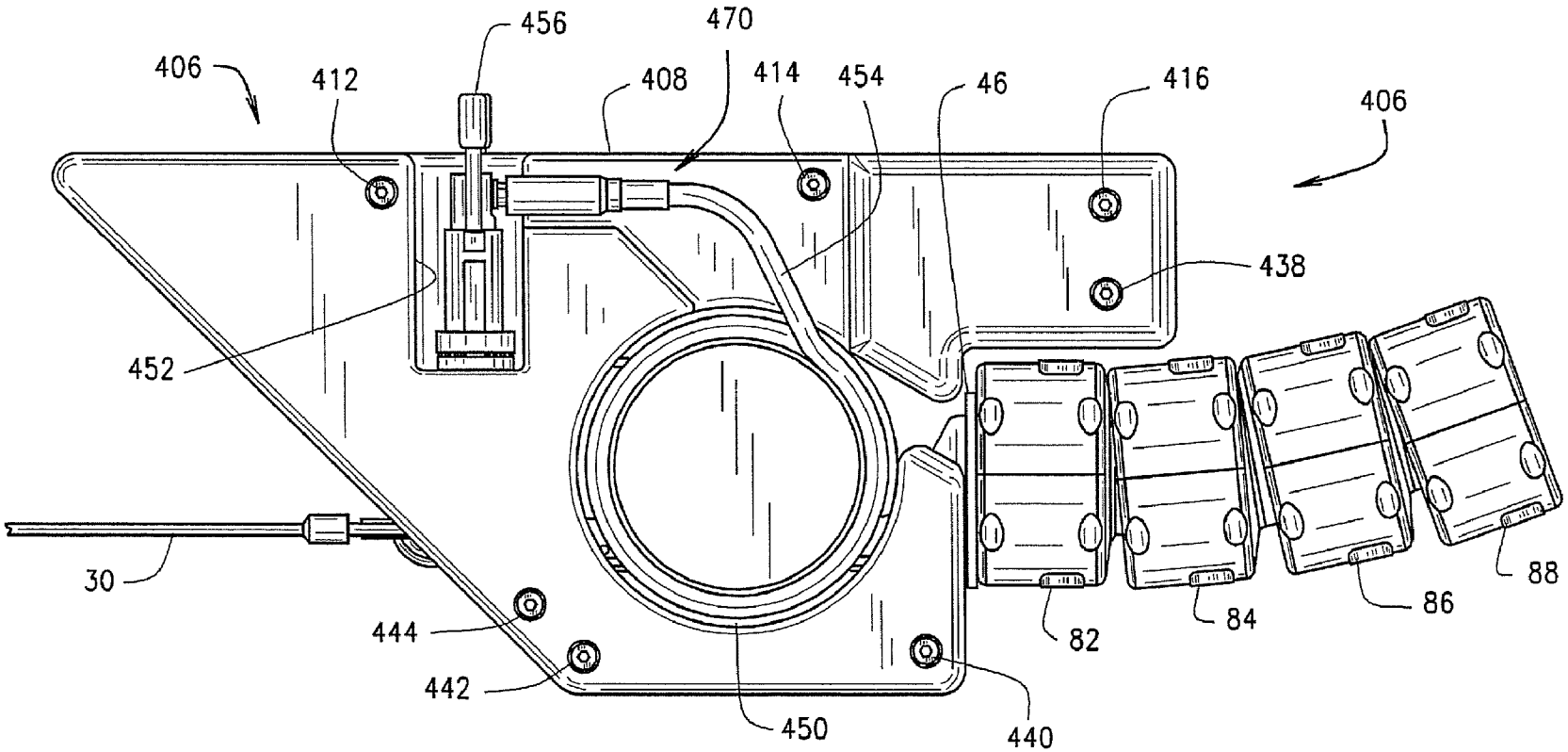
FIG. 25 is an elevation view of the second alternative embodiment of the loose tube flying lead with specialized buoyancy module of FIG. 23.
Figure 26:
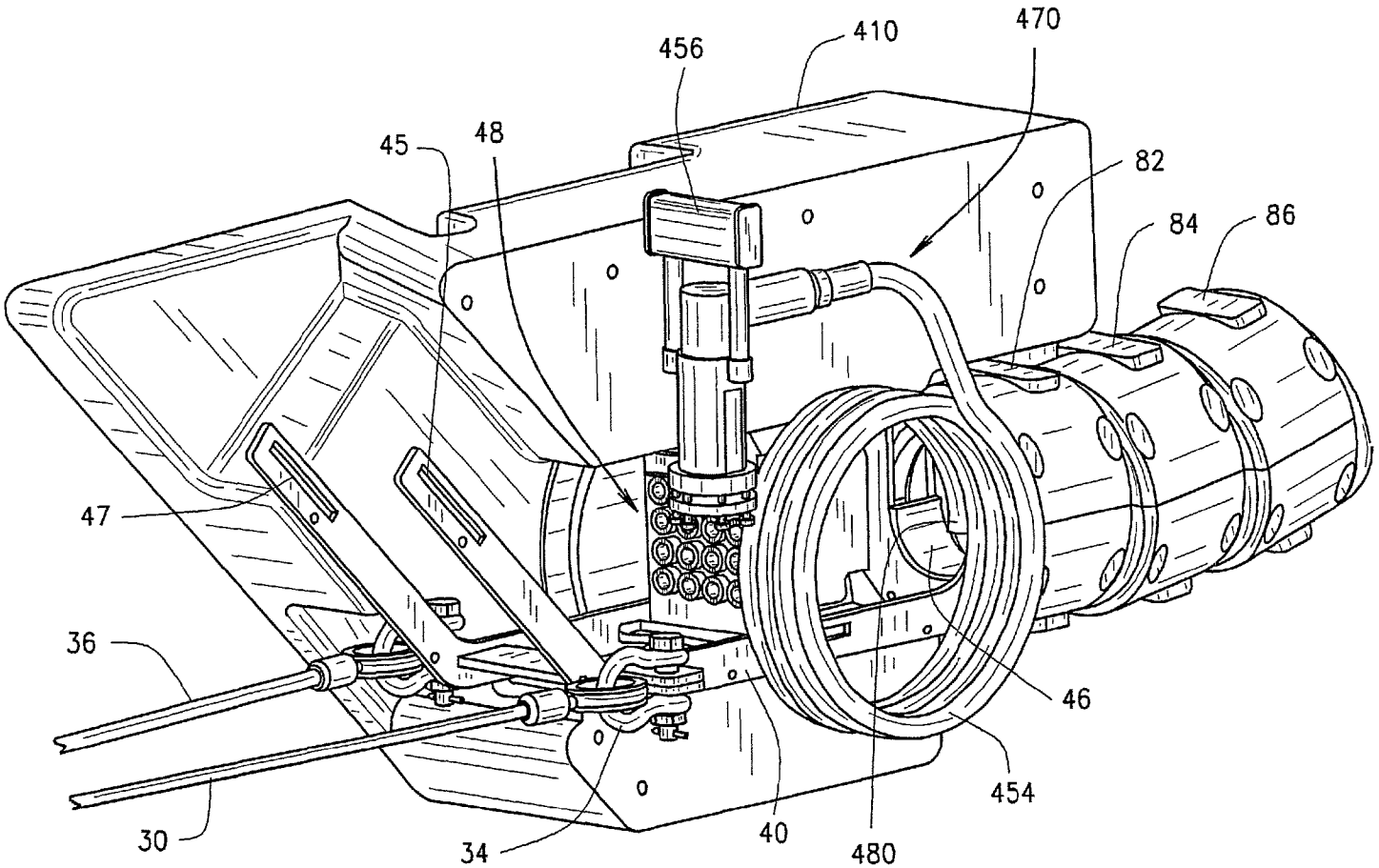
FIG. 26 is a partial cut away view of the second alternative embodiment of the loose tube flying lead with specialized buoyancy module of FIG. 23.

Referring now to FIGS. 23, 24 25 and 26 which together show a second alternative embodiment of the loose tube flying lead 402. FIG. 23 is an isometric view of the second alternative embodiment 402 with specialized buoyancy module 406. FIG. 24 is a top view of the second alternative embodiment 402 with specialized buoyancy module 406 of FIG. 23. FIG. 25 is an elevation view of the second alternative embodiment 402 with specialized buoyancy module 406. FIG. 26 is a partial cut away view of the second alternative embodiment of the loose tube flying lead 402 with specialized buoyancy module 406.

Some oil field operators do not like to include electrical connections in a stab-plate because they feel that such electrical connections are less reliable than a ROV type connector. Other customers may simply want one or two supplemental interior conduits in reserve or for expansion. The flying lead 402 is designed to meet the needs of these customers. Specifically, a first ROV connector assembly 470 is mounted on the left side of the buoyancy module 406 and a second ROV connector assembly 472 is mounted on the right side of the buoyancy module 406. ROV connector assemblies 470 and 472, like stab-plates, are off the shelf items manufactured by a number of different producers listed earlier in the application. These off the shelf items frequently include a length of flexible conduit preassembled with the connector, which is well known to those skilled in the art. These ROV connector assemblies 470 and 472 are used primarily to transmit electric power, electric signals and/or fiber optic signals, as is well known to those skilled in the art. The ROV connectors 470 and 472 may also be used for fluids, such as hydraulic fluid. ROV connectors typically mate with a fixed connector and are secured using a latch mechanism or a collet mechanism, all of which are well known to those skilled in the art.

The buoyancy module 406 is formed from a left element 408 and a right element 410 which are held together by a plurality of elongated bolts 412, 414, 416, 438, 440, 442 and 444. The bolts may be placed in any number of locations for manufacturing convenience. Syntactic foam such as that produced by Flotation Technologies, Inc. of Biddeford, Me. may be suitable for the left and right elements of the buoyancy module.

The buoyancy module 406 is sized and arranged to surround the universal frame 40 and to allow the bend limiter assemblies room to engage the bend limiter connectors on each frame. The buoyancy module is not designed to be removed from the universal frame during or after installation, unlike prior art flying leads. The present buoyancy module also protects the frame from damage during transport installation and retrieval.

The universal frame 40 in FIGS. 23-26 is configured with a interior conduit termination assembly which receives primarily steel tubes. The universal frame in FIGS. 23-26 could also be configured with a wire rope termination assembly instead of the interior conduit termination assembly, as will be appreciated by those skilled in the art. As previously mentioned, the wire rope termination assembly allows the flying lead to be composed primarily of thermoplastic tubes instead of steel tubes.

The left element 408 of the buoyancy module 406 is formed with a barrel 450 facing away from the frame 40. A storage receptacle 452 is also formed in the left element 408. A flexible conduit 454 has a free end 480 and the other end comes off the shelf with a left connector 456. The free end 480 may be ordered off the shelf with either a JIC fitting or a "dry mate" connector, not shown, which are well known to those skilled in the art. The term "dry mate" means that the connection is made up on the surface, before the apparatus is installed subsea. The JIC fitting or the dry mate connector are connected to one end of an interior conduit, not shown. The left ROV connector assembly 470 and the right ROV connector assembly 472 are mirror images of each other. Each assembly has a connector on one end and a free end connected to an interior conduit, as described above. At least a portion of the flexible conduit 454 is coiled in the barrel 450 and the left ROV connector 456 is placed in the storage receptacle 452.

The right element 410 of the buoyancy module 406 is formed with a barrel 460 facing away from the frame 40. A storage receptacle 462 is also formed in the right element 410. A flexible conduit 464 is connected on one end with one of the interior conduits and on the other end with a right ROV connector 466. At least a portion of the flexible conduit 464 is coiled in the barrel 460 and the right connector 466 is placed in the storage receptacle 462.

One advantage of the embodiment shown in FIGS. 23-26 is easier installation than conventional flying leads. The embodiment in FIGS. 23-26 requires the ROV to fly over once to make the connection. Prior art flying leads require multiple trips, because they are often require several different flying leads, i.e. one flying lead for the stab-plate and a second or third flying lead for the electrical connection. This results in savings during installation and retrieval.

The present invention utilizes at least two load bearing assemblies to support the weight of the loose tube flying lead 20. The first load bearing assembly has two alternative configurations, depending on whether the interior conduits are steel tubes or thermoplastic conduits. The term first load bearing assembly 482 of FIGS. 3 and 22 is synonymous with a) the steel tube load bearing assembly 486 of FIG. 3 and b) the plastic hose load bearing assembly 488 of FIG. 22. The first load bearing assembly 482 may be selected from the group consisting of the steel tube loading bearing assembly and the plastic hose load bearing assembly. The first load bearing assembly may also be referred to as a means for supporting the interior conduits. The term second load bearing assembly 484 of FIG. 4 and over-hose load bearing assembly 490 of FIG. 4 are synonymous. The second load bearing assembly may also be referred to as a means for supporting the overhose.

1. First Load Bearing Assembly a) Steel Tube Load Bearing Assembly

The steel tube load bearing assembly 486 is formed from the first interior conduit termination assembly 48, the interior conduits 76, and the second interior conduit termination assembly, not shown. The interior conduit termination assemblies transfer load to the frame 40 on the first cobra head assembly 22 and the frame 39 on the second cobra head assembly 23. This configuration uses primarily steel tubes as interior conduits 76. The second interior conduit termination assembly, not shown, is affixed to the frame 39 on the second cobra head assembly; the second interior conduit termination assembly is a mirror image of he first interior conduit termination assembly 48 of FIGS. 3, 7, 8 and 11.

b) Plastic Hose Load Bearing Assembly

In the alternative, the plastic hose load bearing assembly 488 is formed from the first wire rope termination assembly 382, the wire rope 388 and the second wire rope termination assembly, not shown. The wire rope termination assemblies transmit load to the frame 40 in the first cobra head assembly 22 and the frame 39 on the second cobra head assembly 23. The second wire rope termination assembly, not shown, is affixed to the frame 39 on the second cobra head assembly; the second wire rope termination assembly is a mirror image of the first wire rope termination assembly 382 of FIG. 22.

2. Second Load Bearing Assembly

The second load bearing assembly 484 is formed from the over-hose load bearing assembly 490, portions of which are best seen in *Fig.* 1, 4, 5, and 21. The over-hose load bearing assembly includes the elongate over-hose 78, the first over-hose connector 80, the second over-hose connector 81, the first bend limiter assembly 24 and the second bend limiter assembly 25. The second load bearing assembly transfers the load to the first bend limiter connector 46 on the frame 40 of the first cobra head assembly 22 and transfers load to the second bend limiter connector 25 on the frame 39 of the second cobra head assembly 23.

The invention claimed is:

1. A flying lead assembly, comprising:

a) a pair of cobra head assemblies, having:

a load bearing universal frame configured to engage an interchangeable interface element positioned proximate one end of the load bearing universal frame and a load bearing bend limiter connector positioned proximate the other end of the universal frame;

a first load bearing assembly having an interior conduit termination assembly mounted on said load bearing universal frame between said interchangeable interface element and said load bearing bend limiter connector; and b) an elongate bundle comprising:

a plurality of non-constrained interior conduits; and a second load bearing assembly including an elongate overhose having overhose connectors on each end of said overhose, each overhose connector engaging a bend limiter assembly which engages said load bearing bend limiter connector on each load bearing universal frame.

2. The apparatus of claim 1 further including:

a buoyancy module surrounding at least a portion of the cobra head assembly, the buoyancy module forming a storage container; and a first ROV connector assembly, having an elongate flexible conduit, one end of the flexible conduit connected to the first ROV connector assembly, at least a portion of the elongate flexible conduit placed in the barrel shaped storage container of the buoyancy module.

3. A flying lead assembly, comprising:

a) an elongate bundle comprising:

a plurality of non-constrained interior conduits;

an elongate load bearing over-hose having a first end and a second end; and a pair of load bearing over-hose connectors, one affixed to the first end and the other affixed to the second end of the over-hose, each over-hose connector forming a radial flange on a free end;

b) a pair of cobra head assemblies, having:

a load bearing universal frame having an interface element on one end and a load bearing bend limiter connector on the other end;

a load bearing interior conduit termination assembly mounted on the load bearing universal frame between the interface element and a bend limiter termination assembly to secure each non-constrained interior conduit to the frame; and a buoyancy module surrounding at least a portion of the cobra head assembly, a float forming a storage container for a flexible conduit with one end terminated to a connector; and a first ROV connector assembly, having an elongate flexible conduit, one end of the flexible conduit connected to the first ROV connector assembly and the other end connected to a first interior conduit, the first ROV connector assembly being coiled around a first barrel formed in the buoyancy module;

a second ROV connector assembly, having an elongate flexible conduit, one end of the flexible conduit connected to the second ROV connector assembly and the other end connected to a second interior conduit, the second ROV connector assembly being coiled around a second barrel formed in the buoyancy module; and c) a pair of elongate, flexible load bearing bend limiter assemblies, each engaged on one end to the bend limiter connector of the cobra head assembly and on the other end to the radial flange of the over-hose terminal connector to rotationally and axially secure each cobra head assembly to the over-hose and allow rotational freedom between the cobra head assemblies, the bend limiter assemblies and the over-hose.

4. The apparatus of claim 3 further including a pair of stab-plates, one connected to each interface element on the load bearing universal frame.

5. A flying lead assembly, comprising:

a) an elongate bundle comprising:

a plurality of non-constrained interior conduits;

an elongate load bearing over-hose having a first end and a second end; and a pair of load bearing over-hose connectors, one affixed to the first end and the other affixed to the second end of the over-hose, each over-hose connector forming a radial flange on a free end;

b) a pair of cobra head assemblies, having:

a load bearing universal frame having an interface element on one end and a load bearing bend limiter connector on the other end;

a load bearing wire rope termination assembly mounted on the frame between the interface element and the bend limiter connector to secure a wire rope to the frame;

a buoyancy module surrounding at least a portion of the cobra head assembly, a float forming a storage container for a flexible conduit with one end terminated to a connector;

a first ROV connector assembly, having an elongate flexible conduit, one end of the flexible conduit connected to a ROV connector and the other end connected to a first interior conduit, the first ROV connector assembly being coiled around a first barrel formed in the buoyancy module;

a second ROV connector assembly, having an elongate flexible conduit, one end of the flexible conduit connected to the second ROY connector assembly and the other end connected to a second interior conduit, the second ROV connector assembly being coiled around a second barrel formed in the buoyancy module; and c) a pair of elongate, flexible load bearing bend limiter assemblies, each engaged on one end to the bend limiter connector of the cobra head assembly and on the other end to the radial flange of the over-hose connector to axially secure each cobra head assembly to the over-hose and allow rotational freedom between the cobra head assemblies, the bend limiter assemblies and the over-hose.

6. The apparatus of claim 5 further including a pair of stab-plates, one connected to each interface element on the load bearing universal frame.

7. A flying lead assembly, comprising:

a) an elongate bundle comprising:

a plurality of non-constrained interior conduits;

an elongate load bearing over-hose having a first end and a second end; and a pair of load bearing over-hose connectors, one affixed to the first end and the other affixed to the second end of the load bearing over-hose, each over-hose connector forming a radial flange on a free end;

b) a pair of cobra head assemblies, each comprising:

a load bearing universal frame configured to engage an interchangeable interface element positioned proximate on one end and a bend limiter connector positioned proximate the other end of said universal frame;

a load bearing interior conduit termination assembly mounted on the frame between the interface element and the bend limiter connector to secure each non-constrained load bearing interior conduit to the frame; and c) a pair of elongate, flexible load bearing bend limiter assemblies, each engaged on one end to the bend limiter connector of the cobra head assembly and on the other end to the radial flange of the over-hose connector to axially secure each cobra head assembly to the over-hose and allow rotational freedom between the cobra head assemblies, the bend limiter assemblies and the over-hose.

8. The apparatus of claim 7 further including a pair of stab-plates, one connected to each interchangeable interface element on the load bearing frame.

9. The apparatus of claim 7 including a pair of flotation modules, each sized and arranged to surround at least a portion of one of the cobra head assemblies.

10. The apparatus of claim 9 wherein each cobra head assembly is slightly buoyant so each cobra head assembly floats vertically in the water during installation.

11. A flying lead assembly, comprising:

a) an elongate bundle comprising:

a plurality of non-constrained interior conduits;

an elongate load bearing over-hose having a first end and a second end;

a pair of load bearing over-hose connectors, one affixed to the first end and the other affixed to the second end of the over-hose, each over-hose connector forming a radial flange on a free end; and an elongate load bearing wire rope extending the length of the elongate bundle;

b) a pair of cobra head assemblies, each comprising:

a load bearing universal frame configured to engage an interchangeable interface element positioned proximate on one end and a bend limiter connector positioned proximate the other end of the load bearing universal frame;

a load bearing wire rope termination assembly mounted on the frame between the interface element and the bend limiter connector to secure the wire rope to the universal frame; and c) a pair of elongate, flexible load bearing bend limiter assemblies, each engaged on one end to the bend limiter connector and on the other end to the radial flange of the over-hose terminal connector to axially secure each cobra head assembly to the over-hose and to allow rotational freedom between the cobra head assemblies, the bend limiter assemblies and the over-hose.

12. The apparatus of claim 11 further including a pair of stab-plates, one connected to each interchangeable interface element on the load bearing universal frame.

13. The apparatus of claim 11 including a pair of flotation modules, each sized and arranged to surround at least a portion of one of the cobra head assemblies.

14. The apparatus of claim 13 wherein each cobra head assembly is slightly buoyant so each cobra head assembly floats vertically in the water during installation.

* * * * *